US011655817B2

(12) United States Patent
Na et al.

(10) Patent No.: US 11,655,817 B2
(45) Date of Patent: May 23, 2023

(54) ROTARY COMPRESSOR

(71) Applicant: LG ELECTRONICS INC., Seoul (KR)

(72) Inventors: Sangmin Na, Seoul (KR); Jingyu Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/722,526

(22) Filed: Apr. 18, 2022

(65) Prior Publication Data

US 2022/0412358 A1 Dec. 29, 2022

(30) Foreign Application Priority Data

Jun. 23, 2021 (KR) ..... 10-2021-0081884

(51) Int. Cl.
*F03C 2/00* (2006.01)
*F03C 4/00* (2006.01)
(Continued)

(52) U.S. Cl.
CPC ..... *F04C 23/001* (2013.01); *F01C 21/0809* (2013.01); *F04C 18/3564* (2013.01); *F04C 18/3562* (2013.01); *F04C 23/008* (2013.01)

(58) Field of Classification Search
CPC .. F04C 23/001; F04C 23/008; F04C 18/3562; F04C 18/3564; F01C 21/0809
See application file for complete search history.

(56) References Cited

U.S. PATENT DOCUMENTS 1,974,112 A * 9/1934 Johnson ..... F04C 18/344 418/149
3,171,587 A * 3/1965 Schaller ..... F01C 19/04 418/124
(Continued)

FOREIGN PATENT DOCUMENTS

CN 206785643 12/2017
JP 60-63087 5/1985
(Continued)

OTHER PUBLICATIONS

KR20180091148A—Lee et al.—Rotary Compressor—Aug. 16, 2018—the English Machine Translation (Year: 2018).*
(Continued)

*Primary Examiner* — Theresa Trieu
(74) *Attorney, Agent, or Firm* — Ked & Associates

(57) ABSTRACT

A rotary compressor is provided for which a vane slot is formed in each cylinder, a suction port is disposed at one side of the vane slot in a circumferential direction with a partition wall interposed therebetween, and at least one elastic portion is formed in a penetrated or recessed manner at at least one circumferential side surface of the partition wall or between circumferential side surfaces. Accordingly, an elastic strain of the partition wall may increase to reduce friction loss between the vane slot and a vane, a sealing distance may be secured between axial side surfaces of the partition wall to prevent refrigerant leakage between the vane slot and the suction port, an amount of oil or refrigerant stored between the vane and the vane slot may be increased by virtue of the at least one elastic portion formed on an inner surface of the vane slot defining the partition wall, thereby improving lubricity.

18 Claims, 15 Drawing Sheets

(51) Int. Cl.

| | |
|---|---|
| ***F04C 2/00*** | (2006.01) |
| ***F04C 11/00*** | (2006.01) |
| ***F04C 23/00*** | (2006.01) |
| ***F01C 21/08*** | (2006.01) |
| ***F04C 18/356*** | (2006.01) |

(56) References Cited

U.S. PATENT DOCUMENTS

| | | | | |
|---|---|---|---|---|
| 3,813,193 | A * | 5/1974 | Rinehart | F04C 18/3564 418/63 |
| 5,069,607 | A * | 12/1991 | Da Costa | F04C 18/3564 418/63 |
| 10,465,684 | B2 | 10/2019 | Nishimura et al. | |
| 10,473,102 | B2 | 10/2019 | Lee et al. | |
| 11,002,279 | B2 | 4/2021 | Cho et al. | |
| 2011/0142705 | A1 | 6/2011 | Park et al. | |
| 2019/0024658 | A1* | 1/2019 | Cho | F04C 23/008 |
| 2019/0211823 | A1* | 7/2019 | Morozumi | F04C 18/3564 |

FOREIGN PATENT DOCUMENTS

| | | | | |
|---|---|---|---|---|
| JP | 2012-154235 | | 8/2012 | |
| KR | 10-1998-0053484 | | 9/1998 | |
| KR | 10-2010-0034914 | | 4/2010 | |
| KR | 10-2016-0034071 | | 3/2016 | |
| KR | 10-2017-0092044 | | 8/2017 | |
| KR | 20180091148 | A * | 8/2018 | F04C 18/3564 |
| KR | 10-2019-0011141 | | 2/2019 | |
| KR | 10-2034799 | | 10/2019 | |
| WO | WO 2004/065794 | | 8/2004 | |

OTHER PUBLICATIONS

Korean Office Action issued in Application No. 10-2021-0081884 dated Jul. 12, 2022.

European Search Report issued in Application No. 22171492.6 dated Oct. 21, 2022.

* cited by examiner

*FIG. 8*

| | | Hinge Type | | Roling Piston Type | |
|---|---|---|---|---|---|
| | | RELATED ART | EMBODIMENT | RELATED ART | EMBODIMENT |
| 40Hz | INPUT | 847.8 | 829.8 | 861.3 | 856.0 |
| | % | 100% | 97.9% | 100% | 99.4% |
| | EER | 18.89 | 19.26 | 18.51 | 18.49 |
| | % | 100% | 101.9% | 100% | 99.9% |
| 60Hz | INPUT | 1322.4 | 1294.0 | 1323.4 | 1316.8 |
| | % | 100% | 97.9% | 100% | 99.5% |
| | EER | 18.66 | 19.01 | 18.59 | 18.61 |
| | % | 100% | 101.9% | 100% | 100.1% |
| 80Hz | INPUT | 1871.7 | 1831.2 | 1876.1 | 1860.3 |
| | % | 100% | 97.8% | 100% | 99.2% |
| | EER | 17.96 | 18.28 | 17.87 | 17.93 |
| | % | 100% | 101.8% | 100% | 100.3% |

ROTARY COMPRESSOR

CROSS-REFERENCE TO RELATED APPLICATION(S)

Pursuant to 35 U.S.C. § 119(a), this application claims the benefit of the earlier filing date and the right of priority to Korean Patent Application No. 10-2021-0081884, filed in Korea on Jun. 23, 2021, the contents of which are incorporated by reference herein in their entirety.

BACKGROUND

1. Field

A rotary compressor, and more particularly, a rotary compressor having a barrier wall disposed between a suction port and a vane slot is disclosed herein.

2. Background

A rotary compressor compresses refrigerant using a roller, which turns in a compression space of a cylinder, and a vane which is in contact with or coupled to an outer circumferential surface of the roller to divide the compression space of the cylinder into a plurality of spaces. The compression space may be divided into a suction chamber communicating with a suction port and a discharge chamber communicating with a discharge port.

Rotary compressors may be classified into a rotary roller type and a hinged vane type depending on whether the roller and the vane are coupled to each other. The rotary roller type is configured such that the vane is slidably in contact with an outer circumferential surface of the roller, as disclosed in Japanese Utility Model Publication No. S60-063087 (hereinafter, "Patent Document 1"), which is hereby incorporated by reference, while the hinged vane type is configured such that the vane is coupled to the roller by a hinge, as disclosed in Japanese Patent Publication No. 2012-154235 (hereinafter, "Patent Document 2"), which is hereby incorporated by reference.

A rotary compressor includes a vane slot radially cut in an inner circumferential surface of a cylinder, a suction port disposed at one side of the vane slot in a circumferential direction, and a discharge port or a discharge guide groove communicating with the discharge port, disposed at another side of the vane slot. In particular, a partition wall is disposed between the vane slot and the suction port to isolate the vane slot (or the discharge port) and the suction port from each other.

The suction port of the rotary compressor may be formed through the cylinder from an outer circumferential surface to the inner circumferential surface, as in Patent Document 1 and Patent Document 2, or may be formed through the cylinder from the outer circumferential surface to the inner circumferential surface to be open to both axial side surfaces at an inner circumferential side as in Chinese Utility Model Publication No. 206785643 (hereinafter, "Patent Document 3"), which is hereby incorporated by reference, and Korean Patent Publication No. 10-2010-0034914 (hereinafter, "Patent Document 4"), which is hereby incorporated by reference.

In the rotary compressor, the vane is in contact with or coupled to an outer circumferential surface of the roller to divide a compression space into a suction chamber and a discharge chamber. The roller coupled to an eccentric portion of a rotational shaft turns when the rotational shaft rotates. During the turning, refrigerant is compressed while moving from the suction chamber to the discharge chamber. At this time, the vane is pushed in a circumferential direction (lateral direction) toward the suction chamber due to a pressure load of the discharge chamber, and a suction-side surface of the vane is pressed onto an inner surface of the vane slot in the circumferential direction which defines a partition wall. Then, the vane may not be smoothly moved in and out of the vane slot, which may cause an increase in motor pressure, thereby deteriorating compressor efficiency.

This may occur more severely when the suction port is formed through the cylinder in a radial direction as in Patent Document 1 and Patent Document 2. That is, in the cases of Patent Document 1 and Patent Document 2, as the suction port is formed through the cylinder in the radial direction, peripheral portions of the suction port are connected. Then, the partition wall between the suction port and the vane slot does not secure adequate elasticity, and thereby the pressure load of the discharge chamber cannot be adequately buffered. Accordingly, the vane is excessively closely adhered to the partition wall defining an inner surface of the vane slot, which may interfere with a smooth reciprocating motion, thereby further increasing motor pressure.

In Patent Documents 3 and 4, the partition wall may be separated from the inner circumferential surface of the cylinder as a part of the suction port, that is, a later side surface is open. With this structure, elasticity of the partition wall may be secured compared to Patent Document 1 and Patent Document 2 described above. However, even in the cases of Patent Documents 3 and 4, as both side surfaces in the circumferential direction constituting the partition wall are formed to be flat, a width of the partition wall may increase, which may cause a limit in securing elasticity.

In particular, in the case of Patent Document 4, a technique of providing a stepped recess at an axial side surface of the partition wall is disclosed. However, the recess in Patent Document 4 has a depth of about 0.1 mm, which is too lower than a height of the partition wall, which may cause a limit in generating elastic force to decrease rigidity of the partition wall and bend the partition wall in a direction of the pressure load. Further, in Patent Document 4, the recess is formed from the axial side surface of the partition wall across both side surfaces in the circumferential direction, which may fail to secure a sealing distance between the vane slot and the suction port, thereby causing refrigerant leakage.

BRIEF DESCRIPTION OF THE DRAWINGS

Embodiments will be described in detail with reference to the following drawings in which like reference numerals refer to like elements, and wherein:

FIG. 8 is a test result table showing a comparison result between the twin rotary compressor with the elastic portion according to the embodiment and a related art twin rotary compressor without an elastic portion;

DETAILED DESCRIPTION

Description will now be given of a rotary compressor according to embodiments disclosed herein, with reference to the accompanying drawings. In general, a rotary compressor may have a single cylinder or a plurality of cylinders stacked in an axial direction to define a compression space(s). A rotary compressor having a single cylinder may be defined as a single rotary compressor, and a rotary compressor having a plurality of cylinders may be defined as a twin rotary compressor.

For such a single rotary compressor, one compression space is defined in one cylinder. On the other hand, for such a twin rotary compressor, two or more cylinders are disposed with an intermediate plate interposed therebetween and compression spaces are defined in the respective cylinders. In the twin rotary compressor, suction pipes may independently communicate with the cylinders, or one suction pipe may communicate with the intermediate plate to be diverged into the both upper and lower cylinders. Hereinafter, an example in which suction pipes are independently connected to respective two cylinders in a twin rotary compressor having the two cylinders will be mainly described. However, embodiments may also be applied not only to a single rotary compressor having one cylinder but also to a twin rotary compressor having a single suction pipe.

Figure 1:
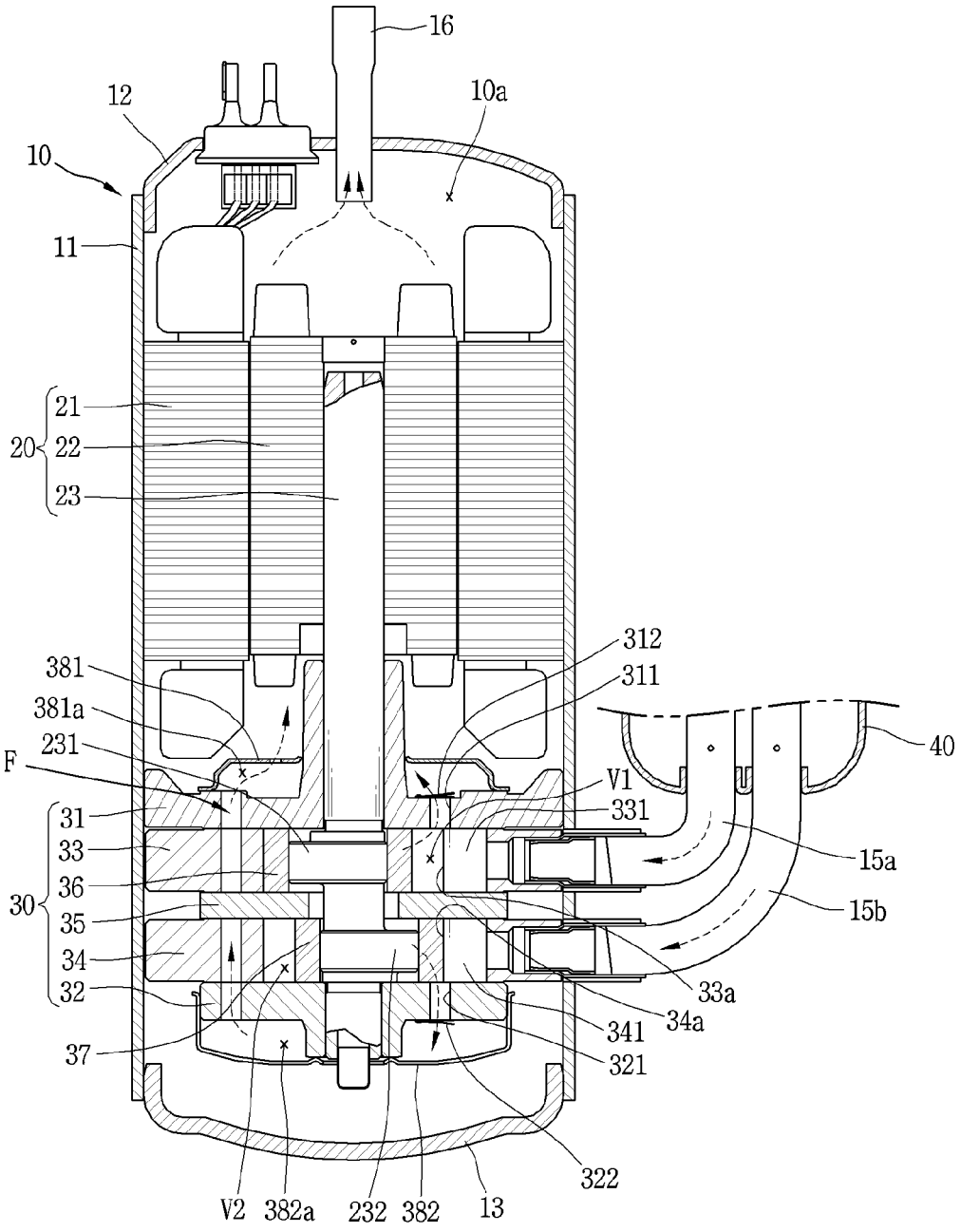
FIG. 1 is a longitudinal view of a twin rotary compressor in accordance with an embodiment.
Figure 2:
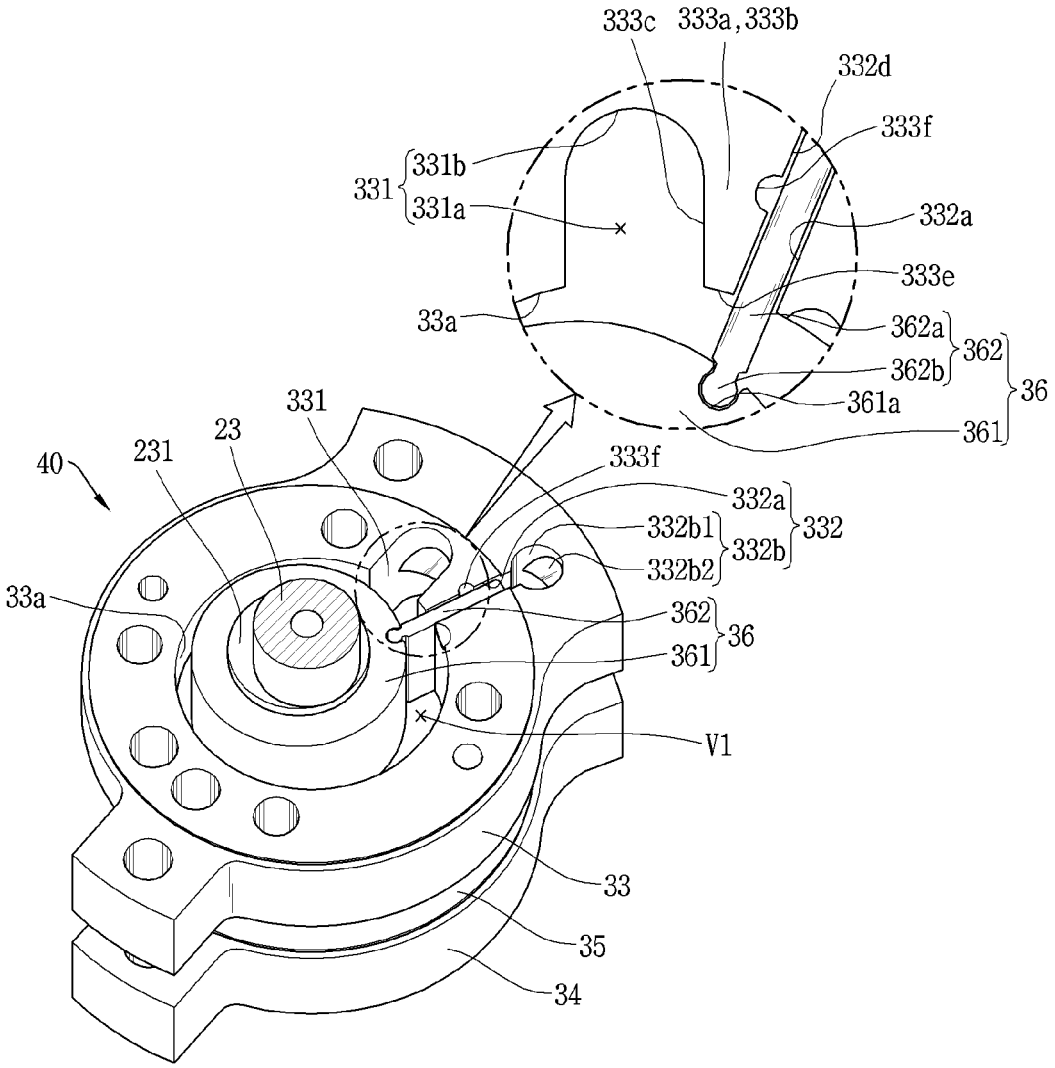
FIG. 2 is a perspective view illustrating a portion of a compression unit in FIG. 1.
Figure 3:
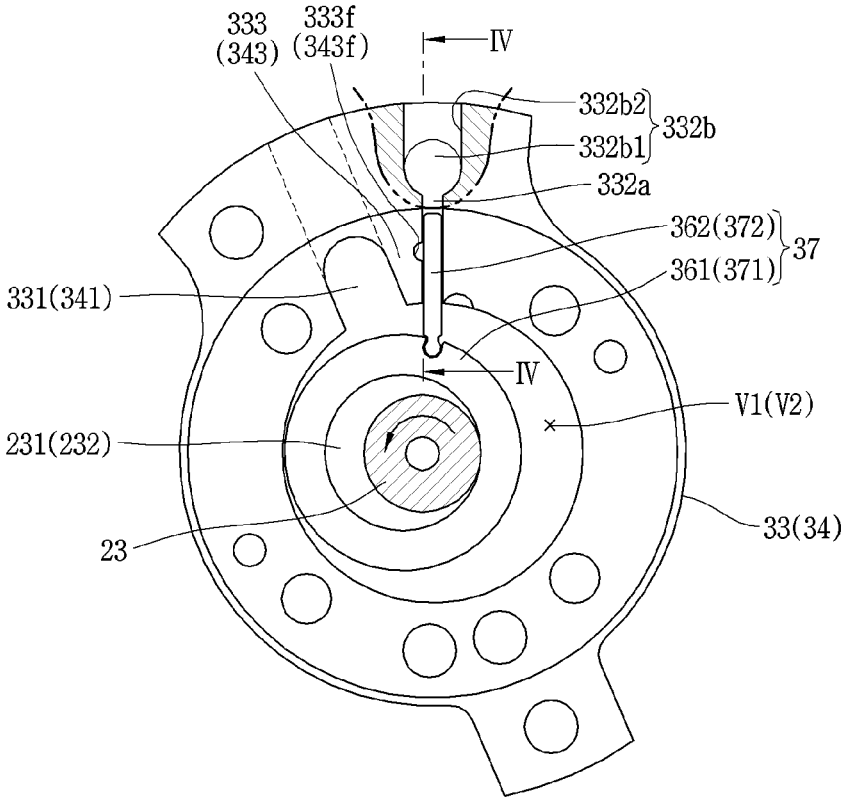
FIG. 3 is a planar view of FIG. 2.
Figure 4:
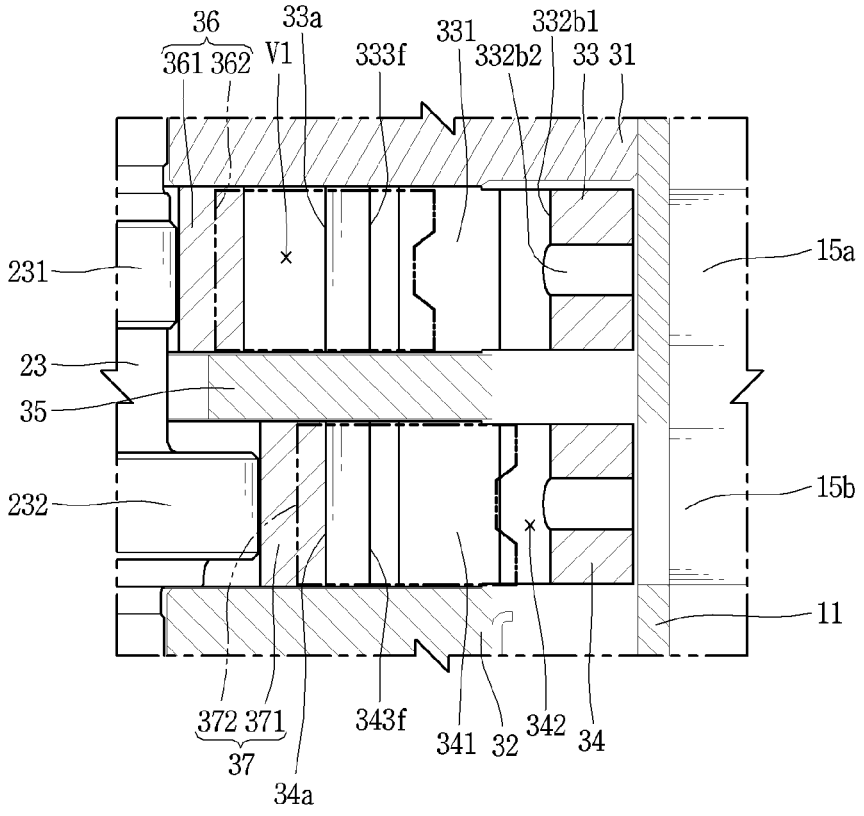
FIG. 4 is a cross-sectional view, taken along the line "IV-IV" of FIG. 3.

FIG. 1 is a longitudinal view of a twin rotary compressor in accordance with an embodiment. FIG. 2 is a perspective view illustrating a part of a compression unit in FIG. 1. FIG. 3 is a planar view of FIG. 2. FIG. 4 is a cross-sectional view, taken along the line "IV-IV" of FIG. 3.

As illustrated in FIG. 1, a twin rotary compressor (hereinafter, "rotary compressor") according to an embodiment may include a motor unit (motor) 20 disposed in an inner space 10*a* of a casing 10, and a compression unit 30 disposed below the motor unit 20 to suction refrigerant, compress the refrigerant, and discharge the refrigerant into the inner space 10*a* of the casing 10. The motor unit 20 and the compression unit 30 may be mechanically connected by a rotational shaft 23.

The casing 10 may include a cylindrical shell 11, an upper cap 12, and a lower cap 13. Both upper and lower ends of the cylindrical shell 11 may be open and the upper and lower caps 12 and 13 may cover the upper and lower openings of the cylindrical shell 11 to seal the inner space 10*a* of the casing 10.

A plurality of suction pipes 15*a* and 15*b* connected to an outlet side of an accumulator 40 may be coupled to a lower half part or portion of the cylindrical shell 11. A discharge pipe 16 may be coupled to the upper cap 12 to be connected to an inlet side of a condenser (not illustrated) through a discharge-side refrigerant pipe. The plurality of suction pipes 15*a* and 15*b* may be inserted through the cylindrical shell 11, respectively, to be directly connected to a first suction port 331 of a first cylinder 33 and a second suction port 341 of a second cylinder 34, which will be described hereinafter. The one discharge pipe 16 may communicate with the inner space 10*a* of the casing 10 through the upper cap 12. The first suction port 331 of the first cylinder 33 and the second suction port 341 of the second cylinder 34 will be described hereinafter.

The motor unit 20 may include a stator 21 and a rotor 22. The stator 21 may be, for example, press-fixed into the casing 10 and the rotor 22 may be rotatably inserted into the stator 21. The rotational shaft 23 may be, for example, press-fitted into a center of the rotor 22.

The rotational shaft 23 may be formed in a hollow shape. One (first) end of the rotational shaft 23 may extend on a same axis to be press-fitted into the rotor 22, and another (second) end of the rotational shaft 23 may include a first eccentric portion 231 and a second eccentric portion 232 to which a first roller (or a first rolling piston) 361 and a second roller (or second rolling piston) 371 described hereinafter are eccentrically coupled.

The first eccentric portion 231 and the second eccentric portion 232 may be disposed at a preset or predetermined distance along an axial direction. For example, the first eccentric portion 231 and the second eccentric portion 232 may be eccentrically disposed with a phase difference of about 180° with respect to a crank angle.

Referring to FIGS. 2 to 4, the compression unit 30 may include a main bearing plate (hereinafter, "main bearing") 31, a sub bearing plate (hereinafter, "sub bearing") 32, first cylinder 33, second cylinder 34, an intermediate plate 35, a first vane roller 36, and a second vane roller 37. The main bearing 31 may be formed in an annular shape and fixedly coupled to an inner circumferential surface of the cylindrical shell 11. The sub bearing 32 may be formed in an annular shape and supportedly coupled by, for example, bolts to the main bearing 31 with the first cylinder 33, the second cylinder 34, and the intermediate plate 35 interposed therebetween.

Although not illustrated in the drawings, the sub bearing 32 may be fixed to the cylindrical shell 11 and the main bearing 31 may be coupled to the sub bearing 32, or both the main bearing 31 and the sub bearing 32 may be fixed to the cylindrical shell 11. In addition, one or more of the first cylinder 33, the second cylinder 34, and the intermediate plate 35 may be fixed to the cylindrical shell 11, and the main bearing 31 and the sub bearing 32 may be supportedly coupled to these components.

The main bearing 31 and the sub bearing 32 may support the rotational shaft 23. The first cylinder 33 and the second cylinder 34 may be disposed at both sides of the intermediate plate 35 in the axial direction, so as to define compression spaces V1 and V2 together with the main bearing 31 and the sub bearing 32.

For example, in the compression unit 30, the main bearing 31 may be disposed on or at an upper surface of the upper first cylinder 33 of the plurality of cylinders 33 and 34, so as to define the first compression space V1, and the sub bearing 32 may be disposed on or at a lower surface of lower second cylinder 34 to define the second compression space V2.

A first discharge port 311 through which refrigerant compressed in the first compression chamber V1 may be discharged may be formed at the main bearing 31 and a first discharge valve 312 that opens and closes the first discharge port 311 may be disposed at an end portion or end of the first discharge port 311. A first discharge cover 381 having a first discharge space 381*a* may be installed on an upper surface of the main bearing 31.

A second discharge port 321 through which refrigerant compressed in the second compression chamber V2 may be discharged may be formed at the sub bearing 32 and a second discharge valve 322 that opens and closes the second discharge port 321 may be disposed at an end portion or end of the second discharge port 321. A second discharge cover 382 defining a second discharge space 382*a* may be installed on a lower surface of the sub bearing 32.

The intermediate plate 35 may be interposed between the first cylinder 33 and the second cylinder 34. The first cylinder 33 may define the first compression space V1 together with the main bearing 31 with the intermediate plate 33 interposed therebetween, and the second cylinder 34 may define the second compression space V2 together with the sub bearing 32.

Referring to FIGS. 1 and 2, first suction port 331 may be formed at the first cylinder 33 and second suction port 341 may be formed at the second cylinder 34, respectively. Accordingly, the first compression space V1 may communicate with the first suction pipe 15*a* through the first suction port 331, and the second compression space V2 may communicate with the second suction pipe 15*b* described hereinafter through the second suction port 341.

The first suction port 331 and the second suction port 341 may be recessed radially from outer circumferential surfaces to inner circumferential surfaces of the first cylinder 33 and the second cylinder 34, respectively, and may be axially open through a top and a bottom of the first cylinder 33 and the first cylinder 33 at inner circumferential sides. Hereinafter, the first suction port 331 and the second suction port 341 will be described as corresponding to portions penetrated in the axial direction at the inner circumferential sides.

The first suction port 331 and the second suction port 341 may be formed in a shape of slots that are radially recessed into inner circumferential surfaces 33*a* and 34*a* of the first cylinder 33 and the second cylinder 34, respectively, and have both axial ends open. Accordingly, open areas of the first suction port 331 and the second suction port 341 may be increased, so that refrigerant may be quickly suctioned into the first compression space V1 and the second compression space V2, respectively.

In addition, the first suction port 331 and the second suction port 341 may be formed at the first cylinder 33 and the second cylinder 34 fully in the axial direction, respectively. Accordingly, a circumferential length of each suction port 331 and 341 may be minimized as compared to a case in which the first suction port 331 and the second suction port 341 are formed at the inner circumferential surfaces 33*a* and 34*a* of the first cylinder 33 and the second cylinder 34 in the form of holes or grooves with a closed top. With this configuration, a suction completion time of refrigerant and a compression starting time may be advanced, and thus, compression cycles in the corresponding compression spaces V1 and V2 may become longer, thereby suppressing over-compression and improving compression efficiency. The first suction port 331 and the second suction port 341 will be described hereinafter again.

The first cylinder 33 may also include a first vane slot 332 into which a first vane 362 is slidably inserted, and the second cylinder 34 may include a second vane slot 342 into which a second vane 372 is slidably inserted. The first vane slot 332 may be formed at one side of the first suction port 331 in a circumferential direction, and the second vane slot 342 may be formed at one side of the second suction port 341 in the circumferential direction. The first vane slot 332 and the second vane slot 342 may be formed on a same axis. Accordingly, in the first compression space and the second compression space, refrigerant may be suctioned, compressed, and discharged with a phase difference of 180° per rotation of the rotational shaft 23.

A first partition wall 333 may be disposed between the first suction port 331 and the first vane slot 332, and a second partition wall 343 may be disposed between the second suction port 341 and the second vane slot 342. Accordingly, the first suction port 331 and the first vane slot 332 may be separated in the circumferential direction by the first partition wall 333, and the second suction port 341 and the second vane slot 342 may be separated in the circumferential direction by the second partition wall 343.

The first partition wall 333 may be defined by an inner surface of the first suction port 331 and an inner surface of the first vane slot 332 adjacent to the inner surface of the first suction port 331 in the circumferential direction. The second partition wall 343 may be defined by an inner surface of the second suction port 341 and an inner surface of the second vane slot 342 adjacent to the inner surface of the second suction port 341 in the circumferential direction. Detailed shapes of the first partition wall 333 and the second partition wall 343 will be described hereinafter.

The intermediate plate 35 may be formed in an annular shape and interposed between the first cylinder 33 and the second cylinder 34. Accordingly, the first compression space V1 and the second compression space V2 may be isolated as different compression spaces by the intermediate plate 35.

The first vane roller 36 may include first roller 361 and first vane 362. As described above, the first roller 361 and the first vane 362 may be formed integrally with each other or may be coupled to each other to be relatively rotatable. Hereinafter, an example in which the first roller 361 and the first vane 362 are coupled to be rotatable will be mainly described.

Referring to FIGS. 2 to 4, the first roller 361 may be formed in a cylindrical shape to be rotatably fitted onto the first eccentric portion 231 of the rotational shaft 23. For example, the first roller 361 may be formed in a shape of a perfect circle in which an inner circumferential surface and an outer circumferential surface have a same center. Alternatively, the first roller 361 may be formed in a shape of an eccentric circle in which an inner circumferential surface and an outer circumferential surface have different centers.

An axial height of the first roller 361 may be substantially equal to a height of the inner circumferential surface of the first cylinder 33. However, the axial height of the first roller 361 may alternatively be slightly lower than the height of the inner circumferential surface of the first cylinder 33. Accordingly, the first roller 361 may perform a sliding motion while being supported in the axial direction with respect to a lower surface of the main bearing 31 and an upper surface of the intermediate plate 35 facing the lower surface of the main bearing 31.

A first hinge groove 361*a* may be formed at an outer circumferential surface of the first roller 361 so that a first hinge protrusion 362*b* of the first vane 362 described hereinafter may be rotatably inserted thereinto. The first hinge groove 361*a* may be formed in an arcuate shape having an open outer circumferential surface along the axial direction of the first roller 361.

An inner diameter of the first hinge groove 361*a* may be larger than an outer diameter of the first hinge protrusion 362*b*. The first hinge groove 361*a* may be large enough to enable a sliding motion of the first hinge protrusion 362*b* while maintaining the inserted state of the first hinge protrusion 362*b*.

The first vane 362 may include a first vane body portion 362*a* and the first hinge protrusion 362*b*. The first vane body portion 362*a* may correspond to a portion inserted into the first vane slot 332 such that the first compression space V1 is divided into a suction chamber and a discharge chamber, and may be formed in a shape of a flat plate with a preset or predetermined length and thickness. For example, the first vane body portion 362*a* may be formed in a rectangular hexahedral shape as a whole. In addition, the first vane body portion 362*a* may have a length that is long enough for the first vane 362 to be located in the first vane slot 332 even after the first roller 361 is completely moved to an opposite side of the first vane slot 332.

The first hinge protrusion 362*b* may extend from an end portion (hereinafter, "front end portion") at an inner circumferential side of the first vane body portion 362*a*. The first hinge protrusion 362*b* may have a cross-sectional area such that it can be inserted into the first hinge groove 361*a* to be rotatable therein. The first hinge protrusion 362*b* may be formed in a semi-circular shape or a shape having a substantially circular cross-section excluding a connecting portion to correspond to the first hinge groove 361*a*.

The second vane roller 37 may include a second roller 371 and a second vane 372. The second roller 371 may include a second hinge groove 371*a*, and the second vane 372 may include a second vane body portion 372*a* and a second hinge protrusion 372*b*. As the second roller 371 and the second vane 372 constituting the second vane roller 37 may have the same structures as those of the first roller 361 and the first vane 362 constituting the first vane roller 36, repetitive description of the second vane roller 37 has been omitted.

In the drawings, unexplained reference F denotes a refrigerant passage.

Hereinafter, operation of a twin rotary compressor according to an embodiment will be described.

When power is applied to the stator 21, the rotor 22 and the rotational shaft 23 may rotate inside of the stator 21 and simultaneously the first vane roller 36 and the second vane roller 37 may perform an orbiting motion. In response to the orbiting motion of the first vane roller 36 and the second vane roller 37, suction chambers of the compression spaces V1 and V2 may change in volume such that refrigerant may be suctioned into the first compression space V1 of the first cylinder 33 and the second compression space V2 of the second cylinder 34.

The suctioned refrigerant may be compressed in the first compression space V1 and the second compression space V2 by the orbiting motion of the first vane roller 36 and the second vane roller 37. The compressed refrigerants may be discharged into the first discharge space 381*a* of the first discharge cover 381 and the second discharge space 382*a* of the second discharge cover 382, respectively, through the first discharge port 311 disposed at the main bearing 31 and the second discharge port 321 disposed at the sub bearing 32.

At this time, the refrigerant discharged into the first discharge space 381*a* may be directly discharged into the inner space 10*a* of the casing 10, while the refrigerant discharged into the second discharge space 382*a* may move toward the first discharge space 381*a* of the first discharge cover 381 through the refrigerant passage F which is defined sequentially through the sub bearing 32, the second cylinder 34, the intermediate plate 35, the first cylinder 33, and the main bearing 31. This refrigerant may then be discharged into the inner space 10*a* of the casing 10 together with the refrigerant discharged from the first compression space V1, so as to circulate along a refrigeration cycle. These series of processes may be repeatedly performed.

On the other hand, while the refrigerant is compressed in the first compression space V1 and the second compression space V2 as described above, the first vane roller 36 and the second vane roller 37 may generate a gas force Fg in a direction that the first roller 361 and the second roller 371 rotate. The gas force Fg may be applied to side surfaces of the first vane 362 and the second vane 372 at discharge chamber sides, respectively, so as to press the first and second vanes 362 and 372 from the discharge chamber sides toward suction chamber sides, namely, sides at which the suction ports 331 and 341 are disposed. At this time, the first vane 362 may be brought into close contact with a circumferential inner surface of the first vane slot 332 adjacent to the first suction port 331 and the second vane 372 may be brought into close contact with a circumferential inner surface of the second vane slot 342 adjacent to the second suction port 341 by the pressing force applied to the first and second vanes 362 and 372. As a result, motor efficiency may be degraded due to frictional loss between the first and second vanes 362 and 372 and the first and second vane slots 332 and 342, thereby deteriorating compression performance.

Accordingly, in embodiments disclosed herein, elastic portions may be formed on the partition walls 333 and 343 located between the suction ports 331 and 341 and the vane slots 332 and 342, respectively, to prevent frictional loss that may occur between the vanes and the vane slots during a compression stroke in the compression spaces.

Elastic portions 333*f* and 343*f* may be formed on the first partition wall 333 between the first suction port 331 and the first vane slot 332 and the second partition wall 343 between the second suction port 341 and the second vane slot 342, or may be formed on only one of the first partition wall 333 and the second partition wall 343. Hereinafter, an example in which the first elastic portion 333*f* is disposed on the first partition wall 333 and the second elastic portion 343*f* is disposed on the second partition wall 343 will be mainly described. However, as the first elastic portion 333*f* and the second elastic portion 343*f* have a same shape, the first elastic portion 333*f* will be mainly described and the second elastic portion 343*f* will be understood by the description of the first elastic portion 333*f*.

In addition, hereinafter, it will be understood that a circumferential inner surface, adjacent to the vane slot, of both circumferential inner surfaces of the suction port 331 denotes an inner surface of the suction port 331 and a circumferential inner surface, adjacent to the suction port, of both circumferential inner surfaces of the vane slot denotes an inner surface of the vane slot 332.

Figure 5:
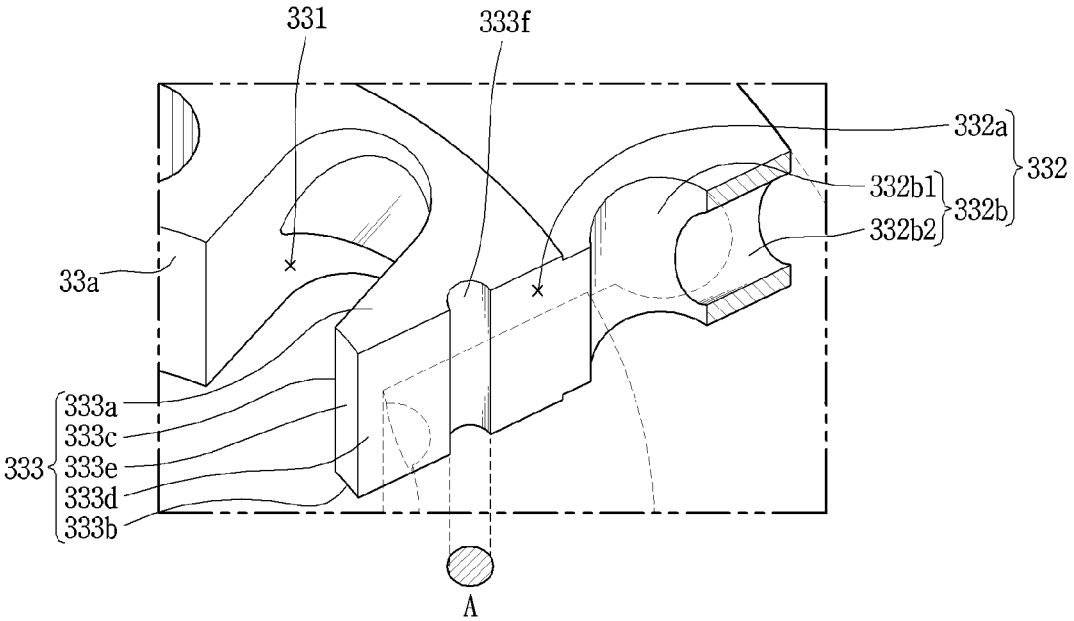
FIG. 5 is a perspective view illustrating a periphery of a partition wall including an elastic portion in accordance with an embodiment.
Figure 6:
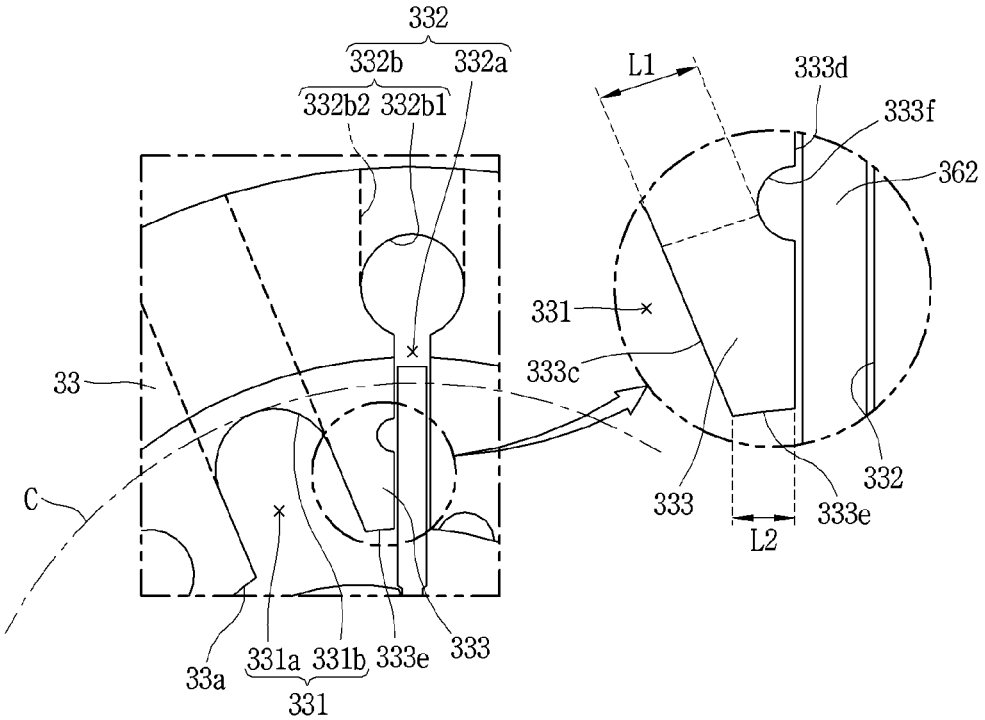
FIG. 6 is a planar view of FIG. 5.

FIG. 5 is a perspective view illustrating a periphery of a partition wall including an elastic portion in accordance with an embodiment. FIG. 6 is a planar view of FIG. 5.

Referring to FIGS. 5 and 6, the first partition wall 333 may be disposed, as described above, between the first suction port 331 and the first vane slot 332 in the circumferential direction. The first suction port 331 and the first vane slot 332 may be formed in a slot shape recessed radially into the inner circumferential surface of the first cylinder 33, and thus, the first partition wall 333 may be formed in a cantilever shape in which an inner circumferential side is a free end.

However, the first suction port 331 and the first vane slot 332 may be formed in a radial direction from a center of the first cylinder 33, and thus, the first partition wall 333 may be formed in a shape having a fan-shaped cross-section or an arcuate cross-section in which the inner circumferential side has a short arcuate length and an outer circumferential side has a long arcuate length. More specifically, the first suction port 331 may include a first spaced portion 331*a* and a first connecting portion 331*b*. Accordingly, the inner circumferential side of the first suction port 331 may be open toward the first compression space V1 and the outer circumferential side of the first suction port 331 may be closed.

The first spaced portion 331*a* may be formed so that a pair of lateral or left and right circumferential inner surfaces are spaced apart from each other at an inner circumferential surface of the first cylinder 33. The first spaced portion 331*a* may be formed such that the circumferential inner surfaces are symmetrical to each other with respect to a center in the circumferential direction. For example, the circumferential inner surfaces, defining the first spaced portion 331*a*, may be parallel to each other in the radial direction or may be formed in an arcuate shape to be closer to each other toward the outer circumferential side.

The circumferential inner surfaces, defining the first spaced portion 331*a*, may be flat surfaces orthogonal to an upper or lower surface of the first cylinder 33, or may be formed as curved surfaces in which a middle portion in the axial direction is recessed. In this embodiment, an example in which the circumferential inner surfaces defining the first spaced portion 331*a* are orthogonal to the upper and lower surfaces of the first cylinder 33 is illustrated.

The first connecting portion 331*b* may connect outer circumferential ends of the circumferential inner surfaces defining the first spaced portion 331*a*. The first connecting portion 331*b* may be formed as a flat surface or a curved surface. In this embodiment, an example in which the first connecting portion 331*b* has a greater curvature than a curvature of the inner circumferential surface or the outer circumferential surface of the first cylinder 33 is illustrated.

The first vane slot 332 may include a first slot portion 332*a* and a first space portion 332*b*. Accordingly, an inner circumferential side of the first vane slot 332 may be open toward the first compression space V1 and an outer circumferential side of the first vane slot 332 may be closed. However, the first space portion 332*b* may be connected to the outer circumferential side of the first vane slot 332.

The first slot portion 332*a* may be defined by circumferential side surfaces spaced apart from each other in the circumferential direction and recessed by a predetermined depth in the radial direction. The circumferential inner surfaces of the first slot portion 332*a* may be formed to be flat so as to be parallel to each other. However, both of the circumferential inner surfaces of the first slot portion 332*a* may be provided with at least one groove, in some examples, so as to define an oil passage or reduce a friction area with the vane.

The first space portion 332*b* may extend radially from the first slot portion 332*a*. For example, the first space portion 332*b* may be formed through the first cylinder 33 in the axial direction, like the first slot portion 332*a*. Accordingly, the first space portion 332*b* may be spaced apart from the outer circumferential surface of the first cylinder 33 by a predetermined distance.

The first space portion 332*b* may communicate with a through hole (not illustrated) formed at the main bearing 31 or the intermediate plate 35. Accordingly, high-pressure refrigerant gas or high-pressure oil accommodated in the inner space 10*a* of the casing 10 may flow into the first space portion 332*b*. The refrigerant or oil may press the first vane 362 toward the first roller 361 and simultaneously lubricate a friction surface between the first vane slot 332 and the first vane 362, so as to reduce a motor load.

When the first elastic portion 333*f* described hereinafter is formed on the inner surface of the first vane slot 332, refrigerant or oil flowing into the first space portion 332*b* may be partially stored in the first elastic portion 333*f*. Thus, an amount of refrigerant or oil remaining between the first vane slot 332 and the first vane 362 may be increased. This can result in improving a lubrication effect between the first vane slot 332 and the first vane 362 by the refrigerant or oil stored in the first elastic portion 333*f*, thereby further lowering the motor load.

The first space portion 332*b* may include only an axial space portion 332*b*1 that penetrates in the axial direction, but in some examples, may include the axial space portion 332*b*1 and a radial space portion 332*b*2. For example, when the first space portion 332*b* includes the axial space portion 332*b*1 and the radial space portion 332*b*2, the radial space portion 332*b*2 may be formed through the outer circumferential surface of the first cylinder 33 and an inner circumferential surface of the axial space portion 332*b*1 so as to be connected to the axial space portion 332*b*1.

In this case, the radial space portion 332*b*2 may overlap the axial space portion 332*b*1 within a range in which it does not pass through the axial space portion 332*b*1, namely, in a range in which it does not overlap the first slot portion 332*a* in the radial direction. With such a configuration, a circumferential length of the first partition wall 333 may be sufficiently secured, thereby preventing damage on the first partition wall 333 due to concentration of stress on an outer circumferential end portion of the first partition wall 333. As the circumferential length of the first partition wall 333 is sufficiently secured, the first elastic portion 333*f* described hereinafter may be formed on the first partition wall 333.

However, in some cases, the radial space portion 332*b*2 may pass through the axial space portion 332*b*1 so as to partially overlap the first slot portion 332*a* in the radial direction. However, even in this case, a length of the radial space portion 332*b*2 by which the radial space portion 332*b*2 overlaps the first slot portion 332*a* in the radial direction should be minimized, for example, an overlapping length of the radial space portion 332*b*2 should be shorter than a width of the first vane slot 332 in the circumferential direction, in view of reliability of the first partition wall 333.

The first partition wall 333 may be defined by the inner surface of the first suction port 331 and the inner surface of the first vane slot 332. As discussed above, the first partition wall 333 may be formed to have the fan-shaped cross-section or the arcuate cross-section in which the inner circumferential side has the short arcuate length and the outer circumferential side has the long arcuate length.

More specifically, the first partition wall 333 may include both axial side surfaces 333*a* and 333*b*, a first circumferential side surface (side surface in the circumferential direction) 333*c*, a second circumferential side surface 333*d*, and an inner circumferential side surface (side surface at the inner circumferential side) 333*e*. Inner circumferential end portions of both of the axial side surfaces 333*a* and 333*b*, an inner circumferential end portion of the first circumferential side surface 333*c*, and an inner circumferential end portion of the second circumferential side surface 333*d* may be connected by the inner circumferential side surface 333*e* defining a portion of the inner circumferential surface 33*a* of the first cylinder 33. Therefore, the first partition wall 333 may have a cantilever shape as described above.

The axial side surfaces 333*a* and 333*b* of the first partition wall 333 may correspond to the axial side surfaces of the first cylinder 33 and face the main bearing 31 and the sub bearing 32, respectively. The axial side surfaces 333*a* and 333*b* of the first partition wall 333 may be flat. In other words, the axial side surfaces 333*a* and 333*b* of the first partition wall 333 may have a same height (length) in the radial direction. Accordingly, even if the first partition wall 333 is short in the circumferential direction, a sealing distance in the axial direction may be secured between the first suction port 331 and the first vane slot 332.

However, in some cases, the axial side surfaces 333*a* and 333*b* of the first partition wall 333 may be formed in a tapered shape to be inclined so that a thickness of the cylinder 33 decreases from the outer circumferential side to the inner circumferential side. Accordingly, the first partition wall 333 may be elastically deformed in response to gas force, thereby reducing friction loss between the first vane 362 and the first vane slot 332.

The first circumferential side surface 333*c* of the first partition wall 333 may correspond to the inner surface of the first suction port 331, and connect the axial side surfaces 333*a* and 333*b* at one or a first side of the axial side surfaces 333*a* and 333*b* in the circumferential direction. The second circumferential side surface 333*d* of the first partition wall 333 may correspond to the inner surface of the second vane slot 332, and connect the axial side surfaces 333*a* and 333*b* at another or a second side of the axial side surfaces 333*a* and 333*b* in the circumferential direction.

The circumferential side surfaces 333*c* and 333*d* of the first partition wall 333 may be flat. Accordingly, the first suction port 331 and the first vane slot 332 may be easily machined. In some examples, however, both of the circumferential side surfaces 333*c* and 333*d* of the first partition wall 333 may be entirely flat and both of the circumferential side surfaces 333*c* and 333*d* may be partially uneven.

In other words, the first elastic portion 333*f* may be recessed by a preset or predetermined depth in the circumferential direction into at least one of the circumferential side surfaces 333*c* and 333*d* of the first partition wall 333. In this embodiment, an example in which the first elastic portion 333*f* is formed at the second circumferential side surface 333*d* defining the first vane slot 332 will be described. For convenience of explanation, the second circumferential side surface 333*c* forming the first suction port 331 is defined as a first side surface, and the second circumferential side surface 333*d* forming the first vane slot 332 is defined as a second side surface. Also, the first circumferential side surface 333*c* and the second circumferential side surface 333*d* will also be used, if necessary.

The first elastic portion 333*f* may be formed to be concave and convex on the second side surface. This may increase elastic force of the first partition wall 333, thereby reducing the friction loss between the vane 362 and the vane slot 332.

The first elastic portion 333*f* may be formed at a position having high resistance to gas force, that is, a position having high resistance to a pressure load applied to the first vane 362, on the second side surface 333*d*. For example, as illustrated in FIG. 6, the first elastic portion 333*f* may be formed such that at least a portion thereof is located within a range of a virtual circle C which has a radius from a center of the first cylinder 33 to an end of an outer circumferential side of the first connecting portion 331*b*, in a manner of being as adjacent to the outer circumferential side of the first partition wall 333 as possible.

More specifically, the first elastic portion 333*f* may be a recess having a predetermined depth in the circumferential direction at the second side surface 332*d* of the first partition wall 333 defining the inner surface of the first vane slot 332. For example, the first elastic portion 333*f* may be formed as a single recess formed through both of the axial side surfaces 333*a* and 333*b*, and may have a semicircular or elliptical cross-sectional shape when projected in the axial direction. Accordingly, the first elastic portion 333*f* may have a curved inner circumferential surface, so as to suppress a decrease in fatigue limit due to stress concentration on the first elastic portion 333*f*.

When the first elastic portion 333*f* is formed to be as deep and wide as possible, it may be effective to mitigate hardness or rigidity of the first partition wall 333. However, when the first elastic portion 333*f* is formed too deeply in the circumferential direction, a sealing distance L1, which is a minimum distance between the first elastic portion 333*f* and the first suction port 331, may be too narrow. Then, a sufficient sealing distance between the vane slot 332 and the suction port 331 may not be secured, which may cause refrigerant or oil of the vane slot 332 to leak toward the suction port, thereby causing suction loss. In addition, when gas force is transmitted to the first partition wall 333 through the first vane 362, stress may be concentrated on a corresponding section of the first elastic portion 333*f*, which may cause damage to the section.

Accordingly, in this embodiment, the sealing distance L1 between the first elastic portion 333*f* and the first suction port 331 may be set to be greater than or equal to at least a length of the first partition wall 333 at the inner circumferential side. Therefore, even if gas force is transferred to the first partition wall 333 through the first vane 362, stress may be concentrated in the vicinity of the first elastic portion 333*f* and breakage or damage may be suppressed accordingly.

Also, the first elastic portion 333*f* may be formed such that at least a portion thereof is located within a radial movement range of the first vane 362. For example, both ends of the first elastic portion 333*f* in the radial direction may be included in a radial range of the first vane 362. Accordingly, when the first vane 362 reciprocates inside of the first vane slot 332, an outer end (or rear end) of the first vane 362 may be prevented in advance from being caught by the first elastic portion 333*f* because the first elastic portion 333*f* is located at a position at which it radially overlaps a side surface of the first vane 362 at a suction side.

Also, the first elastic portion 333*f* may have a same cross-sectional area A in the axial direction. Accordingly, an elastic strain of the first partition wall 333 by the first elastic portion 333*f* may be equally generated in the axial direction. With such a configuration, distortion of the first partition wall 333 may be suppressed, and thus, the first vane 362 may smoothly reciprocate, thereby reducing friction loss and compression loss.

Figure 7:
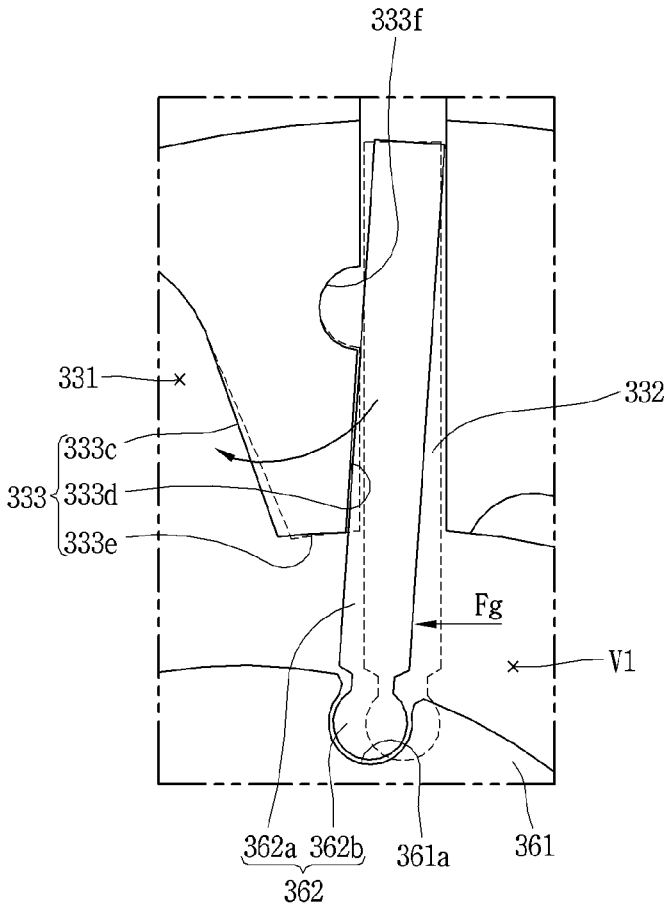
FIG. 7 is a planar view illustrating an elastically-deformed state of a partition wall including an elastic portion in accordance with an embodiment.

FIG. 7 is a planar view illustrating an elastically-deformed state of a partition wall including an elastic portion in accordance with an embodiment. Referring to FIG. 7, when the first elastic portion 333*f* is formed on the side surface 333*d* of the first partition wall 333 constituting the vane slot 332, the first partition wall 333 may be formed in the cantilever shape and simultaneously a cross-sectional area of the partition wall 333 at a root portion thereof may be reduced by a cross-sectional area of the first elastic portion 333*f*. Accordingly, the first partition wall 333 may serve as a kind of buffering partition wall having elasticity.

Then, even if the first vane 362 receives a gas force Fg corresponding to a discharge pressure toward the first suction port 331 in the circumferential direction, the first partition wall 333 may be bent toward the first suction port 331 based on the first elastic portion 333*f*, in response to the gas force Fg. Then, the side surface of the first vane 362 at the suction side may be suppressed from being excessively brought into close contact with the second side surface 333*d* of the first partition wall 333 defining the inner surface of the first vane slot 332. This may reduce the friction loss between the first partition wall 333 (or the first vane slot) and the first vane 362, thereby enhancing compression efficiency.

FIG. 8 is a test result table showing a comparison result between a twin rotary compressor with an elastic portion according to an embodiment and a related art twin rotary compressor without an elastic portion. This test result has been obtained by applying refrigerant 410a. The table in FIG. 8 also shows a comparison result of a case employing the elastic portion 333*f* and a case not employing the elastic portion 333*f* in a hinge type rotary compressor in which a vane is hinged to a roller and a rolling piston type rotary compressor in which a vane is slidably in contact with a roller.

Referring to FIG. 8, in the case of the hinge type rotary compressor, when a motor is operated at rotational speeds of 40 Hz, 60 Hz, and 80 Hz, it can be seen that motor inputs are all lowered and energy efficiency (EER) is improved in the hinge type rotary compressor according to the embodiment, compared to the related art hinge type rotary compressor. In the case of the hinge type rotary compressor, a slip is not formed between the roller and the vane because the roller and the vane are coupled to each other. Therefore, the vane may receive a load according to a turning motion of the roller in addition to the gas force (Fg) of a discharge chamber. This may cause high frictional loss between the vane and the partition wall.

However, when the elastic portion 333*f* is formed on the partition wall as in the embodiment, it can be seen that the friction loss between the vane and the partition wall is reduced by virtue of elastic deformation of the partition wall as described above. This results from the application of the refrigerant R410a. Thus, it may be expected that such an effect will further increase when high pressure refrigerant is applied.

On the other hand, even in the case of the rolling piston type rotary compressor, it can be seen that the energy efficiency is improved as the motor inputs are decreased in some motor rotational speed bands (e.g., 60 Hz, 80 Hz). However, such an effect may not be so great in the rolling piston type rotary compressor, compared to the hinge type rotary compressor. This may result from that a load according to the turning motion of the roller is hardly applied to the vane because the roller and the vane are slidably in contact with each other. However, it can be seen that the effect of the application of the elastic portion 333*f* will be doubled when a pressing force with respect to the rear side of the vane increases or a gap between the roller and the vane is not smoothly lubricated depending on operating conditions. Even in this case, it is a result obtained by applying the refrigerant R410a, and thus, it can be expected that such an effect will further increase when high pressure refrigerant is applied.

Although not illustrated in the drawings, the first elastic portion 333*f* may be formed to be inclined with respect to the axial direction. Even in this case, as the basic configuration of the first elastic portion 333*f* and operating effects thereof are similar to those of the first elastic portion 333*f* formed in the axial direction, repetitive description thereof has been omitted.

In addition, hereinafter, it will be understood that the structure having the first elastic portion 333*f* formed in a penetrating or recessed manner in the axial direction includes a case in which the first elastic portion 333*f* is formed in the penetrating or recessed manner to be inclined with respect to the axial direction.

Hereinafter, another embodiment of the first elastic portion will be described. That is, the previous embodiment illustrates that only one first elastic portion is formed at a position adjacent to the outer circumferential side of the first partition wall, but in some cases, a plurality of first elastic portions may be formed along the side wall surface of the first partition wall.

Figure 9:
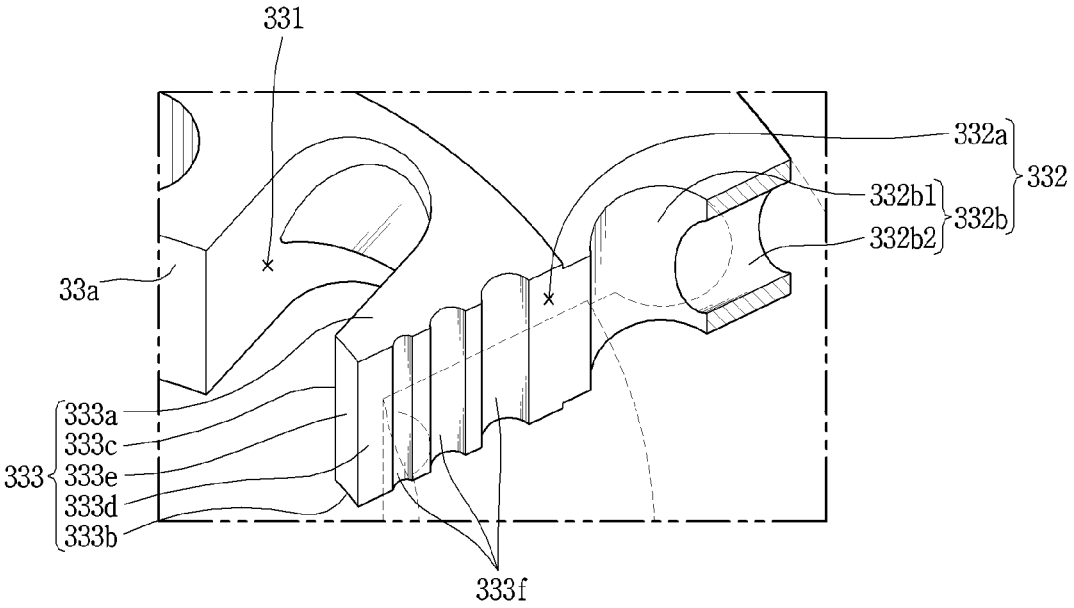
FIG. 9 is a perspective view illustrating a periphery of a partition wall including elastic portions in accordance with another embodiment.
Figure 10:
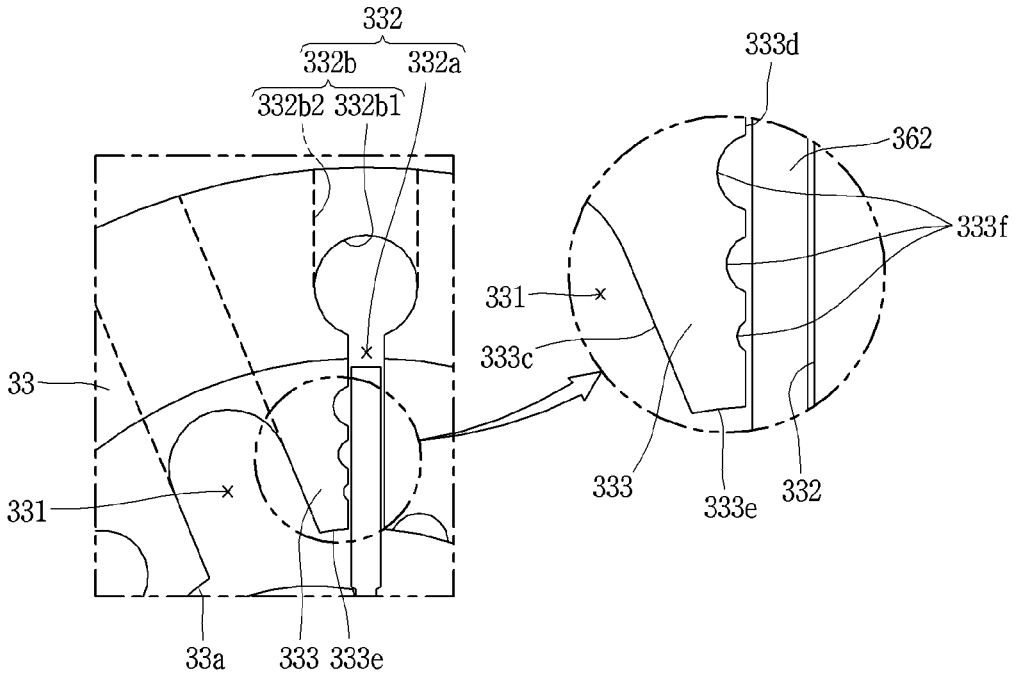
FIG. 10 is a planar view of FIG. 9.

FIG. 9 is a perspective view illustrating a periphery of a partition wall including elastic portions in accordance with another embodiment. FIG. 10 is a planar view of FIG. 9.

Referring to FIGS. 9 and 10, a plurality of the first elastic portion 333*f* according to this embodiment may be provided. The plurality of first elastic portions 333*f* may be disposed radially at preset or predetermined intervals along the second side surface 333*d* of the first partition wall 333 defining the inner surface of the first vane slot 332.

The plurality of first elastic portions 333*f* may be formed to have a same size. However, when projected in the axial direction, the first partition wall 333 may be formed in the shape of the fan-shaped cross-section or arcuate cross-section in which an arcuate length at an outer circumferential side is longer than an arcuate length at an inner circumferential side, and thus, the inner circumferential side may have a small cross-section and the outer circumferential side may have a large cross-section in the circumferential direction. Accordingly, a cross-sectional area (or inner diameter) of the first elastic portion 333*f* located at the outer circumferential side may be larger than a cross-sectional area (or inner diameter) of the first elastic portion 333*f* located at the inner circumferential side, in correspondence with the shape of the first partition wall 333.

As described above, even when the plurality of first elastic portions 333*f* are formed on one side surface 333*c*, 333*d* of the first partition wall 333, the basic configuration of the first elastic portions 333*f* and the operating effects thereof may be similar to those in the previous embodiment. However, in this embodiment, as the plurality of first elastic portions 333*f* is formed at the preset intervals in the radial direction, the first partition wall 333 may be bent or curved based on each of the first elastic portions 333*f* as a starting point. Accordingly, during reciprocating motion of the first vane 362, the first partition wall 333 may be deformed (changed) in response to gas force applied to the first vane 362, thereby more effectively suppressing the friction loss between the first vane 362 and the first vane slot 332.

In addition, when the plurality of first elastic portions 333*f* is formed on the side surface 333*d* of the first partition wall 333 defining the inner surface of the first vane slot 332 as in this embodiment, an area of the inner surface of the first vane slot 332 may be reduced. This may decrease the friction loss between the first vane slot 332 and the first vane 362, so that the friction loss may be more effectively suppressed.

Hereinafter, still another embodiment of the first elastic portion will be described. That is, in the previous embodiments, the first elastic portion is formed on the side surface, to which the gas force is applied, of both of the circumferential side surfaces of the partition wall. However, in some cases, the first elastic portion may be formed on another side surface opposite to the side surface receiving the gas force.

Figure 11:
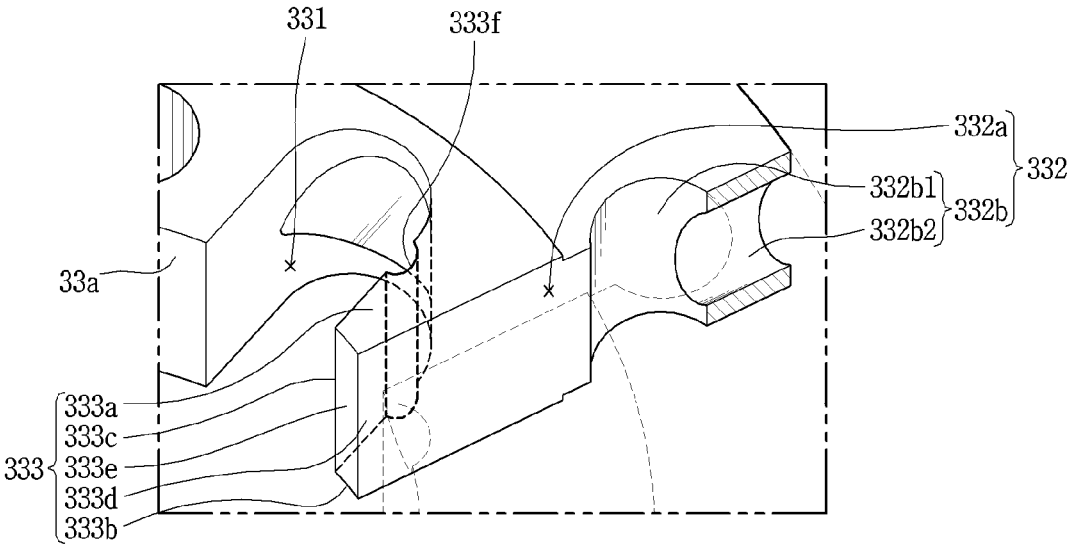
FIG. 11 is a perspective view illustrating a periphery of a partition wall including an elastic portion in accordance with still another embodiment.
Figure 12:
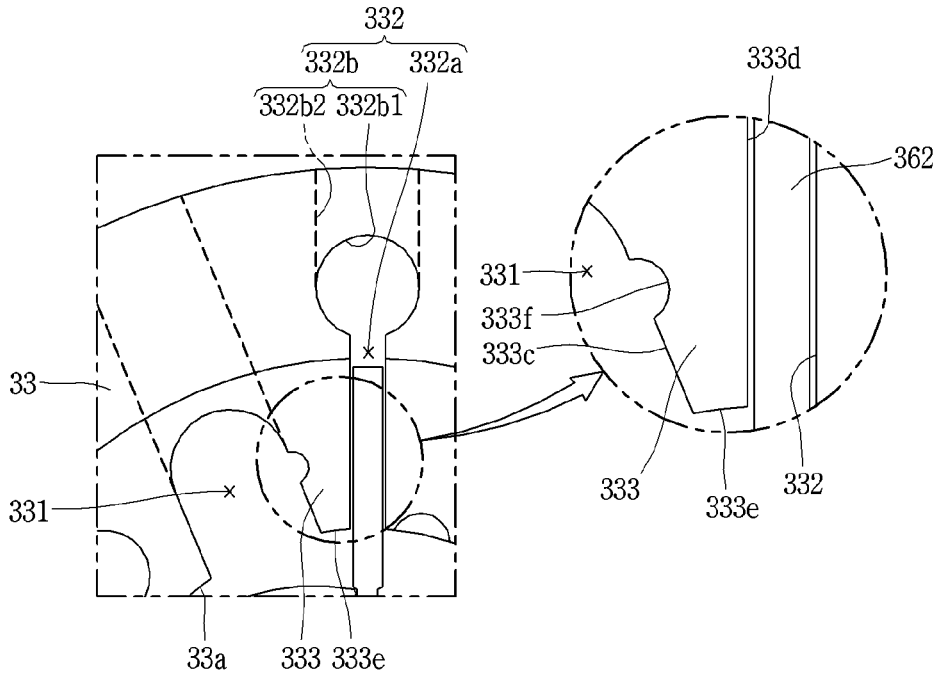
FIG. 12 is a planar view of FIG. 11.

FIG. 11 is a perspective view illustrating a periphery of a partition wall including an elastic portion in accordance with still another embodiment. FIG. 12 is a planar view of FIG. 11.

Referring to FIGS. 11 and 12, the first elastic portion 333*f* according to this embodiment may be formed on the first side surface 333*c* of the first partition wall 333 defining the inner surface of the first suction port 331. In this case, the first elastic portion 333*f* may be formed in a groove shape having a predetermined depth at the first side surface 333*c* of the first partition wall 333 as in the previous embodiments. Only one of the first elastic portion 333*f* may be provided or a plurality may be provided disposed at preset or predetermined intervals in the radial direction as in the embodiment of FIGS. 9 and 10.

As described above, even when the first elastic portion 333*f* is recessed in the first side surface 333*c* of the first partition wall 333 defining the inner surface of the first suction port 331, the basic configuration and operating effects of the first elastic portion 333*f* may be similar to those of the previous embodiments. However, in this embodiment, the first elastic portion 333*f* may be formed at the inner surface of the first suction port 331, which may result in increasing a suction volume of the first suction port 331. Accordingly, flow resistance of suction refrigerant may be reduced and suction loss may be suppressed, thereby enhancing compression efficiency.

In addition, as the first elastic portion 333*f* is recessed in the inner surface of the first suction port 331 at the opposite side of a compressing direction, a circumferential length of the first suction port 331 may be reduced compared to a same suction volume. In other words, as the first elastic portion 333*f* communicates with the inner surface of the first suction port 331, the first elastic portion 333*f* may also be a portion of the first suction port 331. Accordingly, a distance between inner surfaces defining the first spaced portion 331*a* of the first suction port 331 may be narrowed by a cross-sectional area of the first elastic portion 333*f*.

At this time, of the inner surfaces defining the first spaced portion 331*a* of the first suction port 331, an inner side surface far from the first vane slot 332 may be formed to be close to the first vane slot 332. Then, a suction completion time may be advanced, which may extend a compression cycle, and thus, suppress over-compression loss. These effects may be more significantly obtained when a plurality of the first elastic portion is provided.

Although not illustrated in the drawings, the plurality of first elastic portions 333*f* may be continuously formed along the radial direction. In other words, the plurality of first elastic portions 333*f* may be formed to be connected together along the inner surface of the first vane slot 332. Effects to be obtained by such a structure may be similar to those of the first elastic portion 333*f* in a shape of a long groove described hereinafter.

Hereinafter, still another embodiment of the first elastic portion will be described. That is, the previous embodiments illustrate that the first elastic portion has a circular or elliptical cross-section, but in some cases, the first elastic portion may be formed in a shape having a rectangular cross-section.

Figure 13:
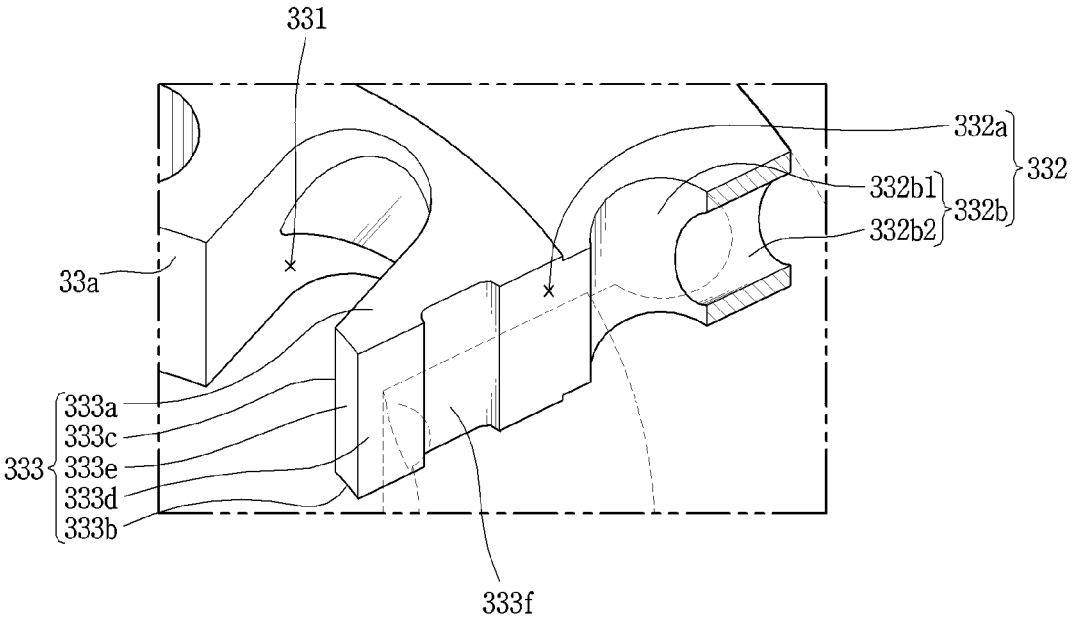
FIG. 13 is a perspective view illustrating a periphery of a partition wall including an elastic portion in accordance with still another embodiment.
Figure 14:
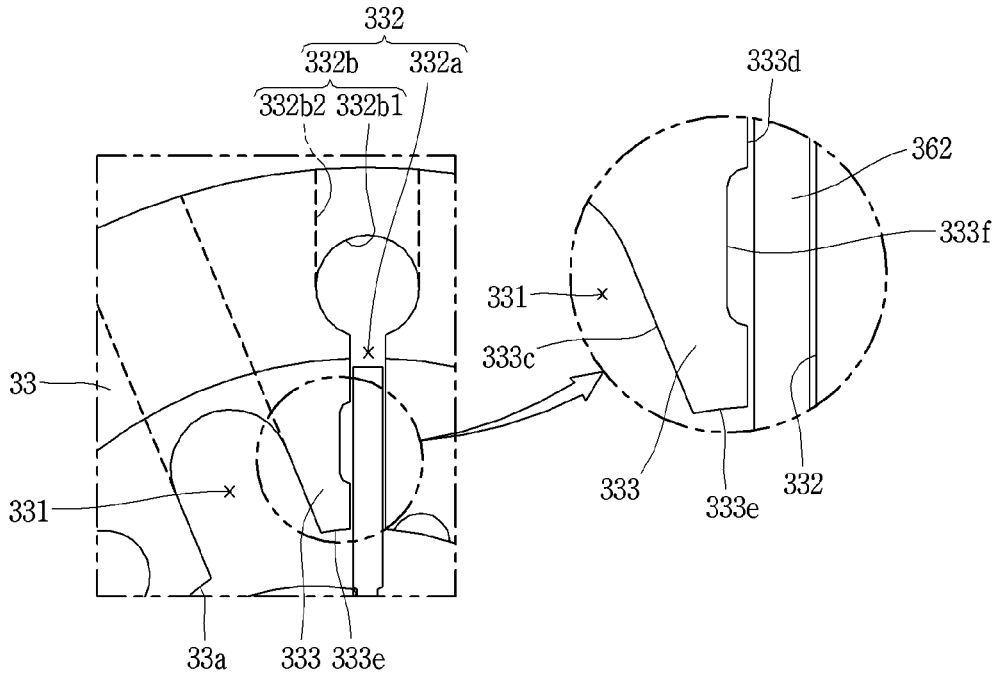
FIG. 14 is a planar view of FIG. 13.

FIG. 13 is a perspective view illustrating a periphery of a partition wall including an elastic portion in accordance with still another embodiment. FIG. 14 is a planar view of FIG. 13.

Referring to FIGS. 13 and 14, the first elastic portion 333*f* according to this embodiment may be formed to extend lengthwise in the radial direction. For example, the first elastic portion 333*f* may have a radial length longer than a circumferential width.

More specifically, the first elastic portion 333*f* may be formed in a shape in which at least a portion has a same width in the circumferential direction, unlike the elliptical cross-sectional shape. For example, the first elastic portion 333*f* may be formed in a shape having a rectangular cross-section which extends lengthwise in the radial direction. However, even in this case, four corners of the first elastic portion 333*f* may be rounded rather than formed at right angles in view of reducing stress concentration.

As described above, even when the first elastic portion 333*f* is formed to have the long rectangular cross-section in the radial direction, the basic configuration of the first elastic portions 333*f* and the operating effects thereof may be similar to those in the previous embodiments. However, in this embodiment, as a radial length of the first elastic portion 333*f* is increased, the elastic strain of the first partition wall 333 may be increased and the friction loss between the first vane slot 332 and the first vane 362 may be further reduced. This may provide an effect similar to that obtained when the first elastic portion 333*f* is formed in the shape having the circular or elliptical cross-section and is provided in plurality continuously as described above.

Hereinafter, still another embodiment of the first elastic portion will be described. That is, the previous embodiments illustrate that the first elastic portion is formed in the penetrating manner in the axial direction, but in some cases, it may also be formed in a shape of being closed at at least one of both axial side surfaces or a middle portion.

Figure 15:
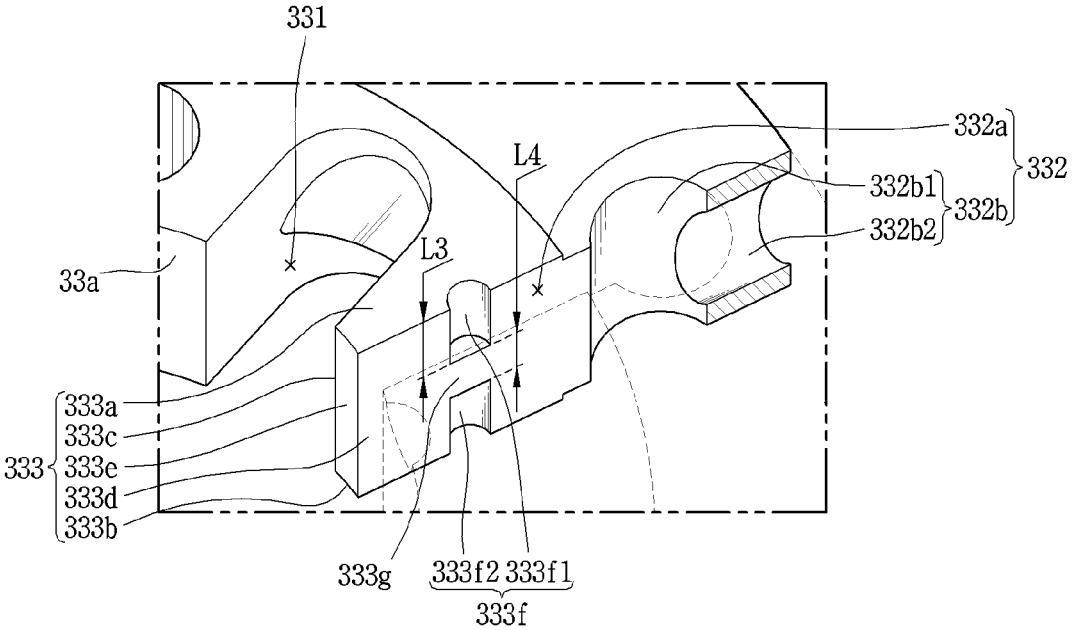
FIG. 15 is a perspective view illustrating a periphery of a partition wall including an elastic portion in accordance with still another embodiment.
Figure 16:
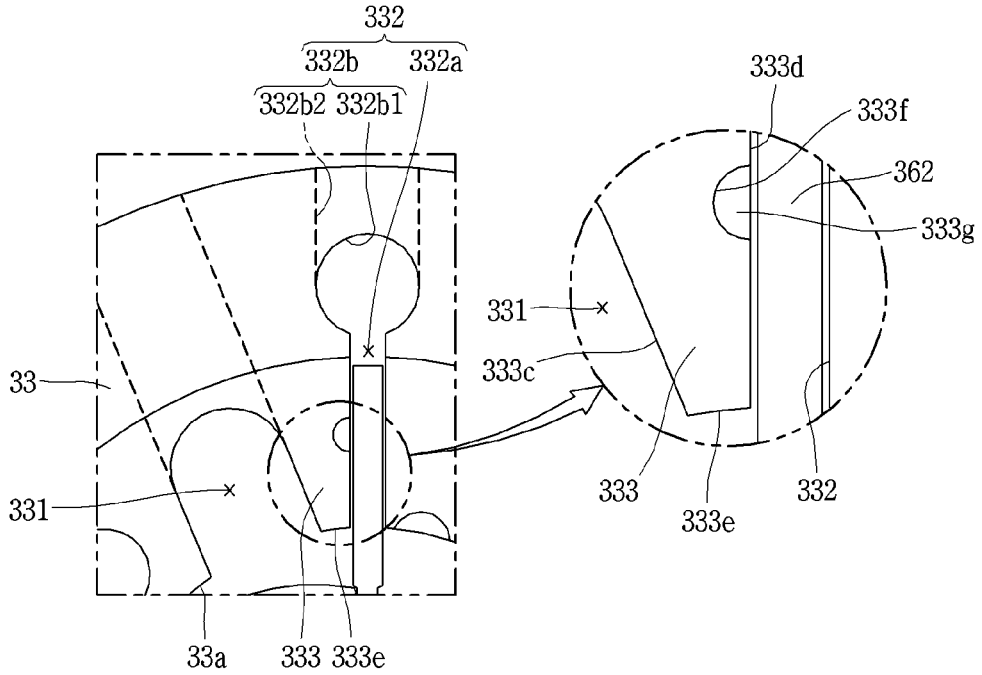
FIG. 16 is a planar view of FIG. 15.

FIG. 15 is a perspective view illustrating a periphery of a partition wall including an elastic portion in accordance with still another embodiment. FIG. 16 is a planar view of FIG. 15.

Referring to FIGS. 15 and 16, the first elastic portion 333*f* according to this embodiment may be formed by being recessed axially by a predetermined depth into both axial side surfaces 333*a* and 333*b* of the first partition wall 333, respectively. For example, an upper first elastic portion 333*f*1 may be recessed axially by a preset or predetermined depth from the upper surface 333*a* to the lower surface 333*b* of the first partition wall 333, and a lower first elastic portion 333*f*2 may be recessed axially by a preset or predetermined depth from the lower surface 333*b* to the upper surface 333*a* of the first partition wall 333. Accordingly, a non-penetrated portion 333*g* may be formed between the upper and lower first elastic portions 333*f*1 and 333*f*2, which may increase a cross-sectional area of the first elastic portion 333*f*, thereby increasing the elastic strain of the partition wall 333 and suppressing damage on the first partition wall 333.

Axial depths L3 of the upper and lower first elastic portions 333*f* (i.e., 333*f*1 and 333*f*2) may be longer than or equal to an axial length L4 of the non-penetrated portion 333*g*. For example, the axial depths L3 of the upper and lower first elastic portions 333*f* may be longer than the axial length L4 of the non-penetrated portion 333*g*. Accordingly, the cross-sectional area of the first elastic portion 333*f* may be larger than that of the non-penetrated portion 333*g*, which may result in securing an appropriate elastic strain of the first partition wall 333.

The upper first elastic portion 333*f*1 and the lower first elastic portion 333*f*2 may be formed symmetrically with respect to the non-penetrated portion 333*g*. For example, a cross-sectional area and depth of the upper first elastic portion 333*f*1 may be equal to a cross-sectional area and depth of the lower first elastic portion 333*f*2. Accordingly, when the first partition wall 333 is elastically deformed, axial strain may be substantially maintained, thereby suppressing distortion of the first partition wall 333.

Hereinafter, still another embodiment of the first elastic portion will be described. That is, the previous embodiments illustrate that the first elastic portion is formed only at one circumferential side surface of the first partition wall, but in some cases, the first elastic portions may be formed at both circumferential side surfaces of the first partition wall.

Figure 17:
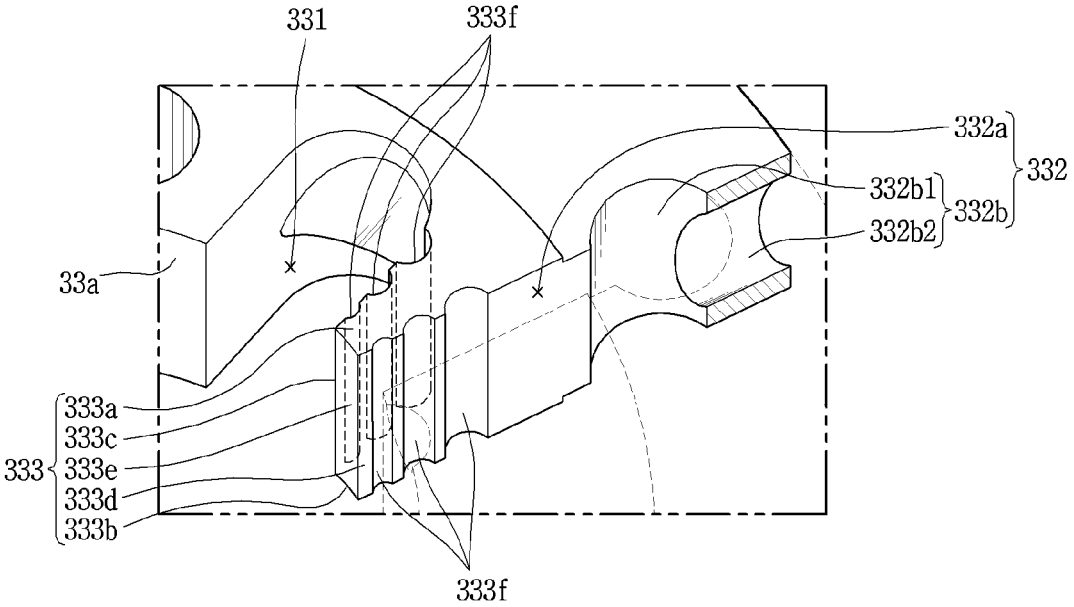
FIG. 17 is a perspective view illustrating a periphery of a partition wall including an elastic portion in accordance with still another embodiment.
Figure 18:
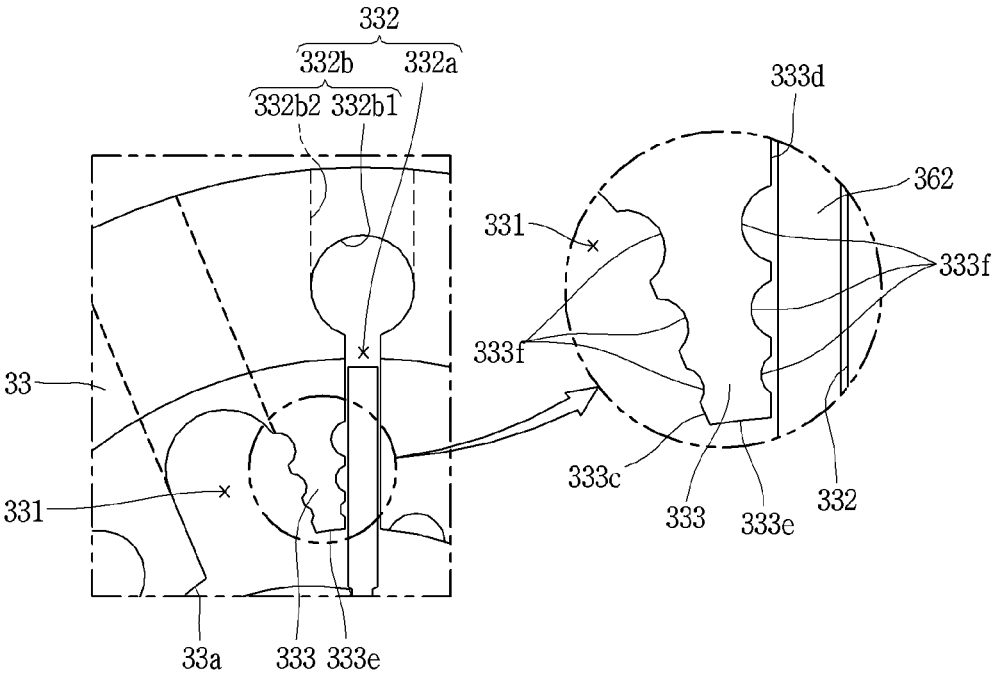
FIG. 18 is a planar view of FIG. 17.

FIG. 17 is a perspective view illustrating a periphery of a partition wall including elastic portions in accordance with still another embodiment. FIG. 18 is a planar view of FIG. 17.

Referring to FIGS. 17 and 18, the first elastic portion 333*f* according to this embodiment may be formed on both circumferential side surface of the first partition wall 333, namely, the first side surface 333*c* defining the inner surface of the first suction port 331 and the second side surface 333*d* defining the inner surface of the first vane slot 332. In this case, one first elastic portion 333*f* formed on the first side surface 333*c* and another first elastic portion 333*f* formed on the second side surface 333*d* may be symmetrical with each other based on a radial center line of the first partition wall 333. Accordingly, the first elastic portion 333*f* may be easily formed on each of the first side surface 333*c* and the second side surface 333*d*.

However, the first elastic portion 333*f* formed on the first side surface 333*c* and the first elastic portion 333*f* formed on the second side surface 333*d* may be formed differently based on the radial center line of the first partition wall 333. For example, the first elastic portion 333*f* formed on the first side surface 333*c* and the first elastic portion 333*f* formed on the second side surface 333*d* may be alternately formed along the radial direction.

In other words, the first elastic portion 333*f* formed on the first side surface 333*c* and the first elastic portion 333*f* formed on the second side surface 333*d* may be formed in a zigzag form when projected in the axial direction. Accordingly, the first elastic portions 333*f* may be formed on the first side surface 333*c* and the second side surface 333*d* of the first partition wall 333 and simultaneously a sealing distance L1 between first elastic portions 333*f* and the circumferential side surfaces facing the same may be secured. With such a configuration, refrigerant leakage between the vane slot 332 and the suction port 331 may be suppressed and simultaneously the first elastic portions 333*f* may be formed deeply, so as to increase the elastic strain of the first partition wall 333 by that much.

As described above, even when the first elastic portions 333*f* are formed in the recessed manner at the first side surface 333*c* of the first partition wall 333 defining the inner surface of the first suction port 331 and the second side surface 333*d* of the first partition wall 333 defining the inner surface of the first vane slot 332, the basic configuration of the first elastic portion 333*f* and the operating effects thereof may be similar to those in the previous embodiments. Therefore, repetitive description thereof has been omitted.

Hereinafter, still another embodiment of the first elastic portion will be described. That is, the previous embodiments illustrate that the first elastic portion is recessed in the circumferential side surface of the first partition wall, but in some cases, the first elastic portion may be formed between the circumferential side surfaces of the first partition wall.

Figure 19:
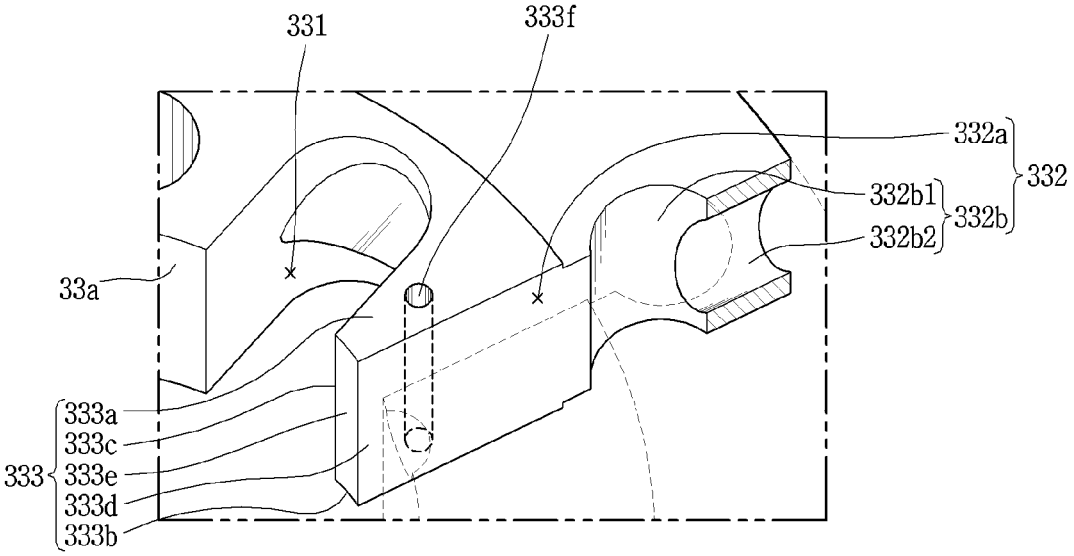
FIG. 19 is a perspective view illustrating a periphery of a partition wall including an elastic portion in accordance with still another embodiment.
Figure 20:
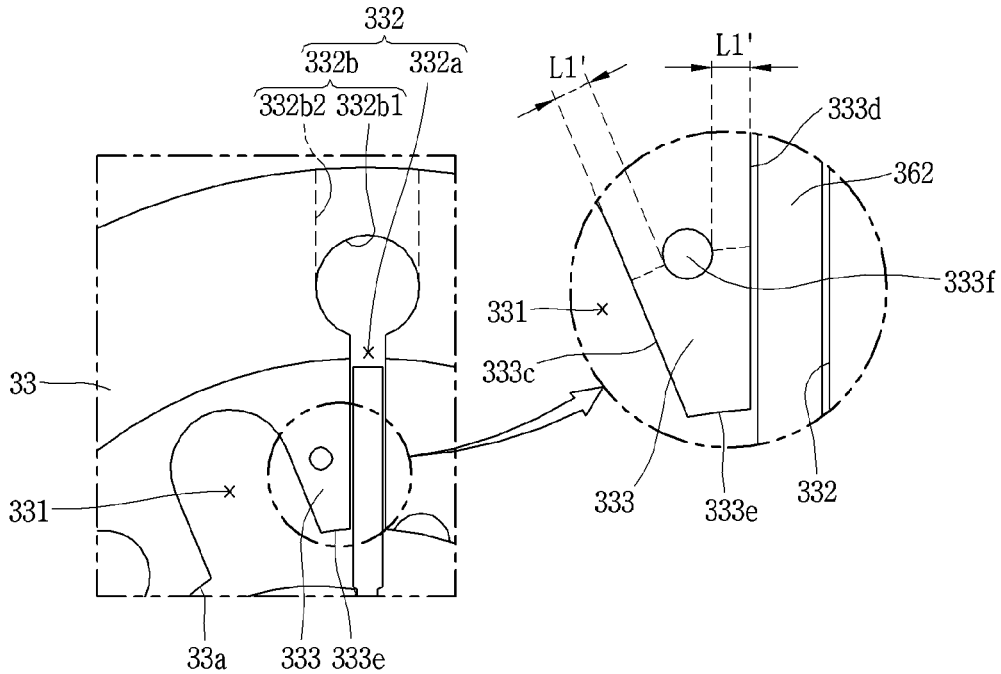
FIG. 20 is a planar view of FIG. 19.

FIG. 19 is a perspective view illustrating a periphery of a partition wall including an elastic portion in accordance with still another embodiment. FIG. 20 is a planar view of FIG. 19.

Referring to FIGS. 19 and 20, the first elastic portion 333*f* according to this embodiment may be formed in a middle position of the first partition wall 333, for example, at a position spaced a preset or predetermined distance apart from the first side surface 333*c* of the first partition wall 333 and the second side surface 333*d* of the first partition wall 333.

More specifically, the first elastic portion 333*f* may be formed at a position spaced apart from the first side surface 333*c* and the second side surface 333*d* by the same distance in the circumferential direction. Accordingly, when the first elastic portion 333*f* is formed in the middle portion of the first partition wall 333, sealing distances L1' may be secured equally at both sides of the first elastic portion 333*f*.

Then, under the condition that the cross-sectional area of the first elastic portion 333*f* is the same, the sealing distances L1' at both sides of the first elastic portion 333*f* may be secured as long as possible. With such a configuration, the first elastic portion 333*f* may be formed in the middle portion of the first partition wall 333 and simultaneously refrigerant leakage between the vane slot 332 and the suction port 331 and a fatigue limit of the first partition wall 333 may all be suppressed.

In this case, the first elastic portion 333*f* may be formed as a hole penetrating through the both axial side surfaces 333*c* and 333*d* of the first partition wall 333. This may be advantageous in view of machining the first elastic portion 333*f* in the middle portion of the first partition wall 333 and also increasing the elastic strain of the first partition wall 333.

As described above, even when the first elastic portion 333*f* is formed as a hole between the first side surface 333*c* and the second side surface 333*d* of the first partition wall 333, the basic configuration of the first elastic portion 333*f* and the operating effects thereof may be similar to the structure of being formed as the groove on the first side surface 333*c* and the second side surface 333*d* of the first partition wall 333 as in the previous embodiment. In other words, the first elastic portion 333*f* may be formed in a shape having a circular or elliptical cross-section, and a plurality may be provided disposed at preset or predetermined distances along the radial direction or to be connected continuously.

However, in this embodiment, as the first elastic portion 333*f* is formed in the middle portion of the first partition wall 333, the first side surface 333*c* and the second side surface 333*d* of the first partition wall 333 may be formed to be flat. Accordingly, the elastic strain of the first partition wall 333 may be increased, the inner surface of the first vane slot 332 may stably support the first vane 362, and an excessive increase in surface pressure may be prevented. In addition, flow loss may be reduced by suppressing an occurrence of turbulence of refrigerant in the first suction port 331.

Hereinafter, another embodiment of the first vane will be described. That is, the previous embodiments illustrate that corners of the outer circumferential end (hereinafter, "rear end") of the first vane are formed at right angles, but in some cases, the corners of the rear end of the first vane may be curved or inclined.

Figure 21:
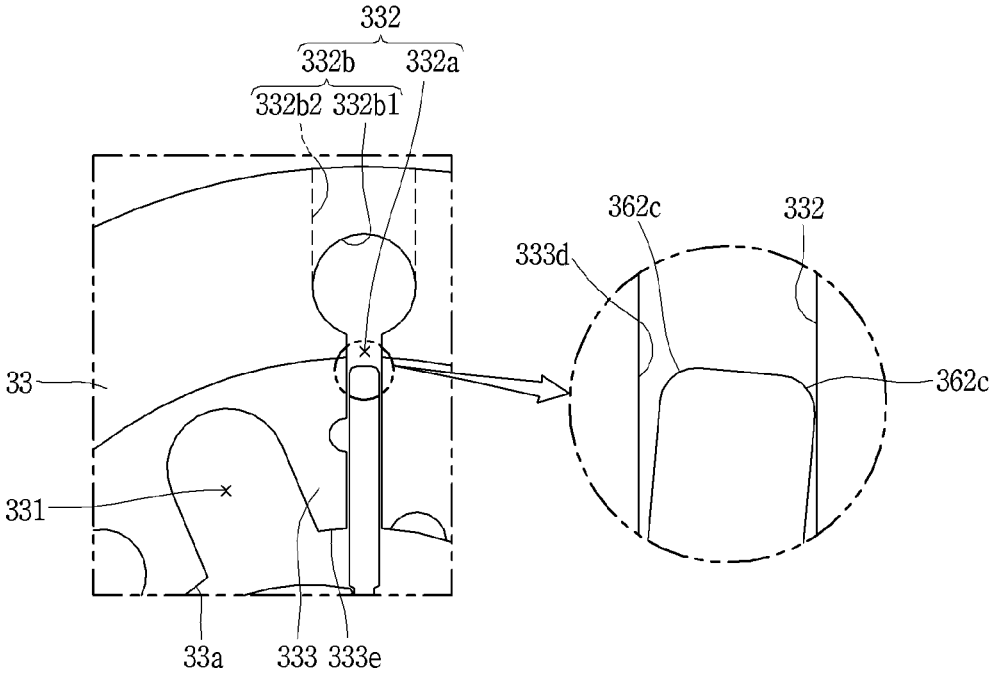
FIGS. 21 and 22 are planar views illustrating vanes in accordance with different embodiments.
Figure 22:
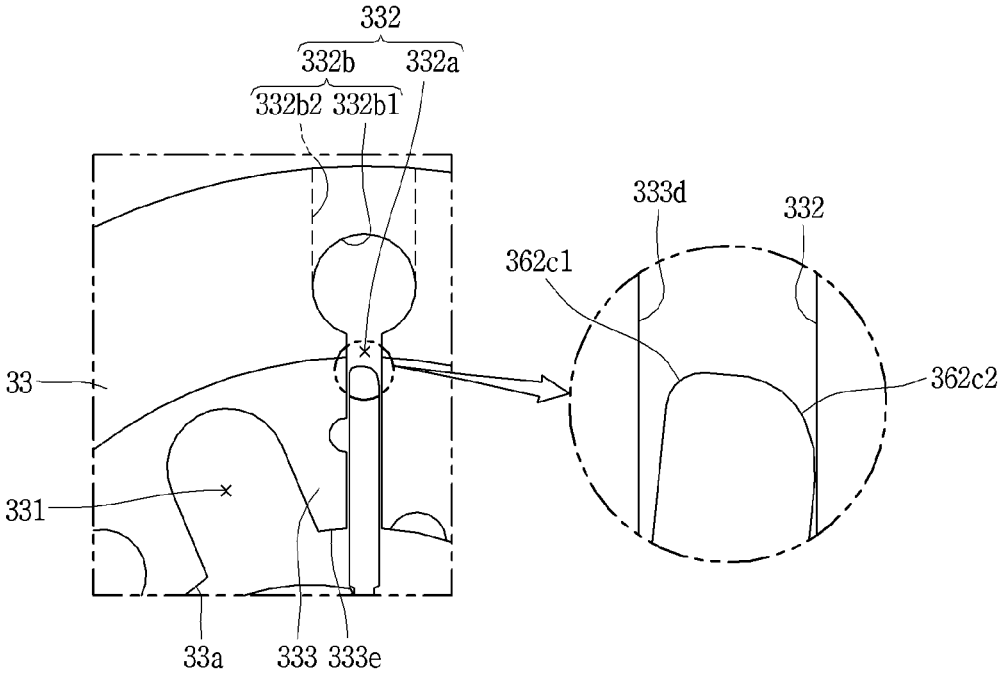

FIGS. 21 and 22 are planar views illustrating vanes in accordance with different embodiments. Referring to FIGS. 21 and 22, the first vane 362 according to this embodiment may include a first vane body portion 362*a* that is slidably inserted into the first vane slot 332, but the first vane body portion 362*a* may be formed in a substantially rectangular parallelepiped shape as described above.

A hinge protrusion 362*b* may extend into a shape having a circular cross-section from a front end portion of the first vane body portion 362*a*. A rear end portion of the first vane body portion 362*a* may be formed to be flat. However, in this embodiment, a first friction-avoiding portion 362*c* may be formed on a rear corner of the first vane body portion 362*a*.

The first friction-avoiding portion 362*c* may be formed by chamfering the corner of the first vane body portion 362*a* to be curved or inclined. The first friction-avoiding portion 362*c* may be formed to be approximately half a width of a rear end portion of the first vane body portion 362*a*. Accordingly, the rear end portion of the first vane body portion 362*a* may be smoothly reciprocated by being pressed toward the first roller 361 by high-pressure refrigerant or high-pressure oil that is introduced into the first space portion 332*b*. At the same time, even if the first partition wall 333 is elastically deformed by the first elastic portion 333*f*, the rear corner of the first vane body portion 362*a* may be prevented from being excessively brought into close contact with the inner surface of the first vane slot 332.

In addition, the first friction-avoiding portions 362*c* may be formed at both rear corners of the first vane body portion 362*a*, respectively. In this case, the first friction-avoiding portions 362*c* may be formed in a same size at both of the rear corners as illustrated in FIG. 21 or may be formed in different sizes as illustrated in FIG. 22.

For example, as illustrated in FIG. 22, the first friction-avoiding portions 362*c*1 and 362*c*2 may be formed at both rear corners, respectively. The first friction-avoiding portion 362*c*2 at a discharge side may be more rounded or inclined than the opposite first friction-avoiding portion 362*c*1 at a suction side, which faces the second side surface 333*d* of the first partition wall 333. Accordingly, even when the front end portion of the first vane 362 is inclined toward the first suction port 331 due to the elastic deformation of the first partition wall 333, a rear corner far from the first partition wall 333, of the corners of the rear end portion of the first vane 362, may be prevented from being excessively in close contact with the inner surface of the first vane slot 332 facing the rear corner, thereby suppressing an increase in surface pressure.

Although not illustrated in the drawings, the first friction-avoiding portion 362*c* may be formed only at one rear corner of both rear corners. In this case, the first friction-avoiding portion 362*c* may be formed at the rear corner farthest from the first partition wall 333. Accordingly, as discussed above, even if the first partition wall 333 is elastically deformed by the first elastic portion 333*f*, the rear corner of the first vane 362 may be prevented from being excessively in close contact with the inner surface of the first vane slot 332, thereby suppressing the increase in surface pressure.

On the other hand, the previous embodiments illustrate that the first suction port and the second suction port are radially recessed from the outer circumferential surfaces to the inner circumferential surfaces of the cylinders, respectively, and are open at the inner circumferential sides in the vertical axial direction of the cylinders. However, those embodiments may also be applied equally to a case in which a suction passage connected with a suction pipe is formed radially in the intermediate plate and suction ports are formed at the inner circumferential surfaces of the first cylinder and the second cylinder to communicate with the suction passage of the intermediate plate. Even in this case, an elastic portion may be formed on the partition wall in the same configuration, and thus, the same effects may be obtained.

Figure 23:
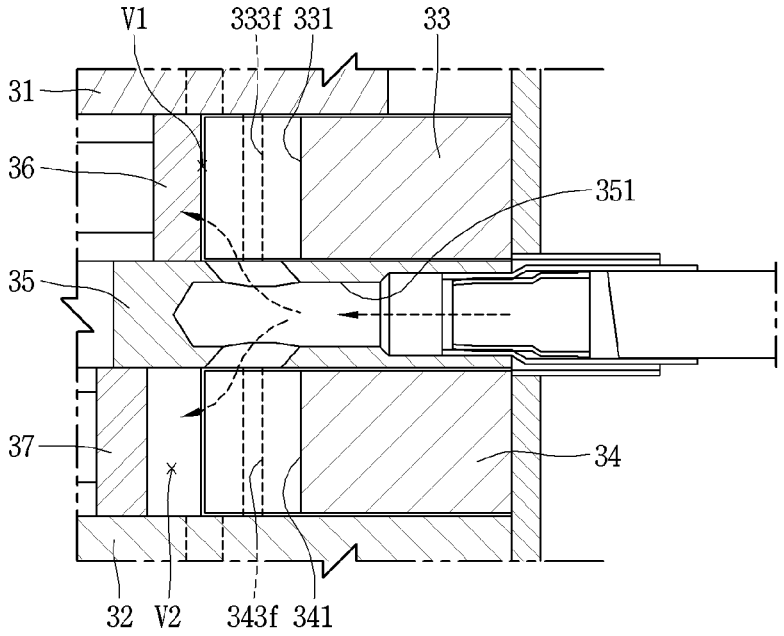
FIG. 23 is a longitudinal sectional view of a compression unit of a twin rotary compressor in accordance with another embodiment.
Figure 24:
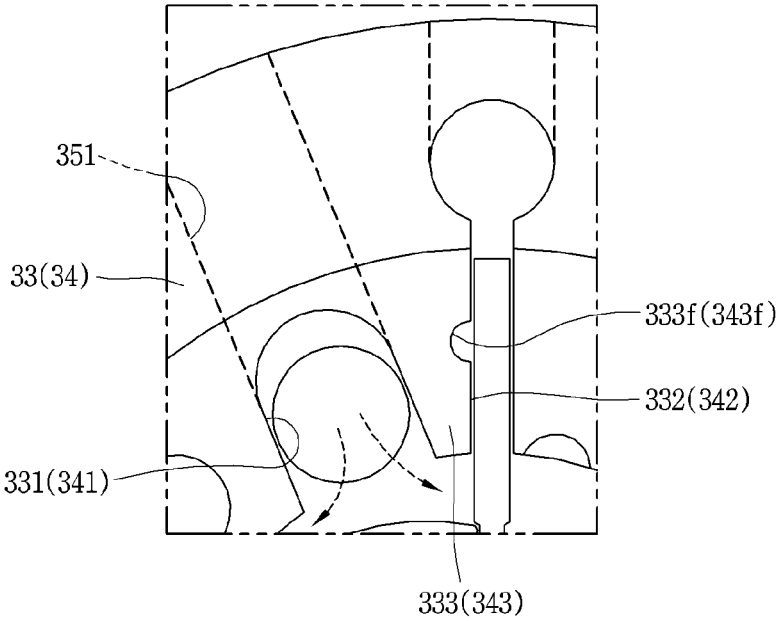
FIG. 24 is a planar view of the compression unit of FIG. 23.

FIG. 23 is a longitudinal sectional view illustrating a compression unit of a twin rotary compressor in accordance with another implementation. FIG. 24 is a planar view illustrating the compression unit of FIG. 23.

Referring to FIGS. 23 and 24, a basic configuration and operating effects of a twin rotary compressor according to this embodiment are similar to those of the previous embodiment illustrated in FIG. 1. For example, the twin rotary compressor according to this embodiment may include first cylinder 33, first roller 361, first vane 362, second cylinder 34, second roller 371, second vane 372, and intermediate plate 35. First compression space V1 may be defined in the first cylinder 33 and second compression space V2 may be defined in the second cylinder 34. The first compression space V1 and the second compression space V2 may be isolated from each other by the intermediate plate 35. Accordingly, a (first) portion of suctioned refrigerant may be compressed in the first compression space V1 and another (second) portion of the suctioned refrigerant may be compressed in the second compression space V2 so as be to discharged into the inner space 110*a* of the casing 10.

However, the intermediate plate 35 according to this embodiment may include one suction passage 351 to which one suction pipe is connected. The suction passage 351 may communicate with the first suction port 331 disposed at the first cylinder 33 and the second suction port 341 disposed at the second cylinder 34.

At least one of the first suction port 331 or the second suction port 341 may be formed in a slot-like shape which is recessed into an inner circumferential surface and open through both axial side surfaces. This embodiment exemplarily illustrates that the first suction port 331 and the second suction port 341 are both formed in the slot-like shape.

The first vane slot 332 may be disposed at one side of the first suction port 331 in the circumferential direction with the first partition wall 333 interposed therebetween. The second vane slot 342 may be disposed at one side of the second suction port 341 in the circumferential direction with the second partition wall 343 interposed therebetween.

Elastic portion 333*f*, 343*f* may be disposed at at least one of the first partition wall 333 or the second partition wall 343 in a recessed or penetrating manner. This embodiment illustrates that the elastic portions 333*f* and 343*f* are formed at the first partition wall 333 and the second partition wall 343, respectively.

The elastic portion 333*f*, 343*f* may be formed in a range of the first suction port 331 and/or the second suction port 341 in the radial direction. Shape and operating effects of the elastic portion 333*f*, 343*f* may be the same as those in the previous embodiments illustrated in FIGS. 5, 9, 11, 13, 15, 17, and 19, and thus, repetitive description thereof has been omitted.

Previous embodiments mainly illustrate the example in which the elastic portion is applied to a twin rotary compressor, but the same may also be applied to a single rotary compressor. In addition, embodiments may be equally applied to a rotary compressor, such as a rolling piston rotary compressor or a centrifugal rotary compressor having an elliptical roller, in which a partition wall is interposed between a suction port and a vane slot, in addition to the hinge type rotary compressor as in the previous embodiments.

Embodiments disclosed herein provide a rotary compressor capable of improving energy efficiency by suppressing a vane from being excessively in close contact with an inner surface of a vane slot. Embodiments disclosed herein also provide a rotary compressor capable of increasing an elastic strain of a partition wall defining an inner surface of the vane slot.

Embodiments disclosed herein further provide a rotary compressor capable of securing reliability by preventing breakage, damage, or distortion of a partition wall while increasing an elastic strain of the partition wall. Embodiments disclosed herein furthermore provide a rotary compressor capable of suppressing refrigerant or oil in a vane slot from leaking into a suction port while increasing elastic force of a partition wall.

Embodiments disclosed herein provide a rotary compressor capable of securing an appropriate sealing distance between a vane slot and a suction port. Embodiments disclosed herein also provide a rotary compressor capable of enhancing lubrication between a vane slot and a vane while increasing elastic force of a partition wall. Embodiments disclosed herein further provide a rotary compressor capable of securing an amount of refrigerant or oil filled between a vane and a vane slot.

Embodiments disclosed herein provide a rotary compressor that may include at least one cylinder, at least two bearing plates, at least one roller, and at least one vane. The cylinder may be formed in an annular shape. The bearing plates may be respectively disposed at both sides of the cylinder in an axial direction. The roller may rotate or revolve inside of the cylinder. The vane may be slidably inserted into the cylinder and may be slidable or coupled in contact with an outer circumferential surface of the roller. The cylinder may include a vane slot having an inner circumferential surface open so that the vane is slidably inserted, a suction port having an inner circumferential surface open and disposed at one side of the vane slot in a circumferential direction, and a partition wall disposed between the vane slot and the suction port to partition the vane slot and the suction port from each other. The partition wall may include an elastic portion formed in a penetrating or recessed manner at at least one of both circumferential side surfaces thereof or between the both circumferential side surfaces. Accordingly, an elastic strain of the partition wall may increase to reduce friction loss between the vane slot and the vane, a sealing distance may be secured between axial side surfaces of the partition wall to prevent refrigerant leakage between the vane slot and the suction port, and an amount of oil or refrigerant stored between the vane and the vane slot may increase by virtue of the elastic portion recessed into an inner surface of the vane slot defining the partition wall, thereby improving lubrication efficiency.

In some examples, the elastic portion may be recessed by a preset or predetermined depth in the circumferential direction into at least one of an inner surface of the vane slot or an inner surface of the suction port both defining the circumferential side surfaces of the partition wall. Accordingly, the elastic portion may be formed easily, thereby enhancing an elastic strain of the partition wall. When the elastic portion is formed on the vane slot, a friction area of the vane slot may be reduced, thereby reducing friction loss between the vane and the vane slot. On the other hand, when the elastic portion is formed on the suction port, a suction area may increase to advance a compression starting time, thereby reducing compression loss due to over-compression.

More specifically, the elastic portion may be located at a position, at which the same overlaps the vane in a radial direction, on the inner surface of the vane slot defining one of the circumferential side surfaces of the partition wall. Accordingly, the vane may be prevented in advance from being caught on the elastic portion during a reciprocating motion of the vane.

As another example, the elastic portion may be formed axially in a penetrating or recessed manner spaced in the circumferential direction apart from an inner surface of the vane slot and an inner surface of the suction port both defining the circumferential side surfaces of the partition wall. This may allow the elastic portion to be formed with a wide cross-sectional area and also simplify machining of the elastic portion. In addition, the vane slot and the suction port may be formed flat, which may reduce suction pressure between the vane slot and the vane and prevent an occurrence of turbulence at the suction port.

As another example, the elastic portion may be spaced apart from the both circumferential side surfaces of the partition wall at a same sealing distance in the circumferential direction. Accordingly, sealing distances at both sides of the elastic portion may be secured as long as possible under a condition that the elastic portion has a same cross-sectional area, thereby preventing refrigerant leakage between the vane slot and the suction port and a fatigue limit of the partition wall.

As another example, a plurality of the elastic portion may be provided. The plurality of elastic portions may be spaced apart at preset or predetermined distances along a radial direction of the partition wall. Accordingly, a spaced distance with respect to the elastic portion may be secured, and thus, reliability of the partition wall may be maintained and active elastic deformation of the partition wall may be made, thereby further reducing friction loss.

More specifically, the partition wall may be configured such that a cross-sectional area at an inner circumferential side is smaller than a cross-sectional area at an outer circumferential side. The elastic portion may be configured such that a cross-sectional area of the elastic portion located at the inner circumferential side of the cylinder is smaller than a cross-sectional area of the elastic portion located at the outer circumferential side of the cylinder. Thus, the partition wall may be elastically deformed into a curved shape while securing a uniform width in the circumferential direction, thereby maintaining reliability.

As another example, the elastic portion may be formed in a rectangular shape in which at least a portion thereof has a same width in the circumferential direction and extends lengthwise in a radial direction. This may increase a radial length of the elastic portion, and thus, improve an elastic strain of the partition wall, thereby further reducing friction loss between the vane slot and the vane.

As another example, the elastic portion may be recessed by a preset or predetermined depth axially into at least one of both axial side surfaces of the partition wall. The partition wall may include a non-penetrated portion formed by blocking an inner end portion of the elastic portion in the axial direction. This may increase a cross-sectional area of the elastic portion so as to improve an elastic strain of the partition wall and prevent a fatigue failure of the partition wall.

More specifically, an axial depth of the elastic portion may be greater than or equal to an axial length of the non-penetrated portion. Accordingly, although the elastic portion has a larger cross-sectional area than that of the non-penetrated portion, an appropriate elastic strain of the partition wall may be secured.

More Specifically, the elastic portion may be formed on both axial side surfaces of the partition wall to be symmetrical with respect to the non-penetrated portion. With this configuration, an axial strain of the partition wall may be maintained substantially the same during elastic deformation of the partition wall, thereby suppressing distortion of the partition wall.

The elastic portion may be formed with the same cross-sectional area along the axial direction. This may facilitate formation of the elastic portion and suppress distortion of the partition wall, thereby enhancing reliability.

The vane may include a friction-avoiding portion chamfered on at least one of both corners of an opposite end portion of the roller. This may prevent the vane from being excessively in contact with an inner surface of the vane slot due to elastic deformation of the partition wall, thereby suppressing an increase in surface pressure between the vane and the vane slot. More specifically, the friction-avoiding portion may be formed such that a friction-avoiding portion at a discharge side is more rounded or inclined than an opposite friction-avoiding portion at a suction side, facing an inner surface of the vane slot defining the partition wall. With this configuration, even if a roller-side end portion of the vane is bent toward the suction port together with the partition wall, a corner of the vane opposite to the roller-side end portion may be prevented from being excessively in contact with a discharge-side inner surface of the vane slot.

The suction port may be recessed by a preset or predetermined depth radially into an inner circumferential surface of the cylinder, and may be open toward at least one of both axial side surfaces of the cylinder. The elastic portion may be formed at a position where the same overlaps the suction port in the radial direction. With this configuration, an elastic strain of the partition wall may be improved and a suction area may be increased to advance a compression starting time, thereby preventing compression loss due to over-compression.

More specifically, the suction port may include a spaced portion spaced apart from an inner circumferential surface of the cylinder in the circumferential direction, and a that connects portion connecting outer circumferential ends of the spaced portion. The elastic portion may be formed such that at least a portion thereof is located within a range of a virtual circle having a radius from a center of the cylinder to an outer circumferential end of the connecting portion. This may improve a practical effect of the elastic portion, thereby increasing an elastic strain of the partition wall.

More specifically, a sealing distance between the elastic portion and an inner surface of the suction port defining the circumferential side surface of the partition wall may be longer than or equal to an inner circumferential length of the partition wall. This may secure an elastic strain of the partition wall and enhancing reliability of the partition wall.

More specifically, a space portion may further extend from a radial outer end of the vane slot, so as to be larger than a circumferential width of the vane slot. The elastic portion may be spaced apart from the space portion at a radially inner side than the space portion. Accordingly, the partition wall may be spaced apart from the space portion, which may allow the elastic portion to be formed at the partition wall and enhance reliability of the partition wall.

The space portion may include an axial space portion that penetrates through the both axial side surfaces of the cylinder, and a radial space portion that communicates from an outer circumferential surface of the cylinder to an inner circumferential surface of the axial space portion. The radial space portion may be defined outside of a range of the vane slot in the radial direction.

One end of the vane may be rotatably coupled to or may integrally extend from the outer circumferential surface of the roller. Accordingly, in a hinge-type rotary compressor in which a roller and a vane are coupled to each other, friction loss between the vane and the vane slot may be reduced, and thus, energy efficiency may be enhanced.

A hinge groove may be formed on the outer circumferential surface of the roller and a hinge protrusion may be formed on one end of the roller to be rotatably coupled to the hinge groove.

Embodiments disclosed herein provide a rotary compressor that may include a first cylinder, a first roller, a first vane, a second cylinder, a second roller, a second vane, and an intermediate plate. The first cylinder may form a first compression chamber, and may include a first suction port that communicates with the first compression chamber so as to be connected with a first suction pipe, and a first vane slot formed at one side of the first suction port. The first roller may be rotatably disposed in the first compression chamber. The first vane may be inserted into the first vane slot to be slidably coupled to the first cylinder, and rotatably coupled to an outer circumferential surface of the first roller. The second cylinder may be disposed at one side of the first cylinder in an axial direction, and form a second compression chamber isolated from the first compression chamber. The second cylinder may include a second suction port that communicates with the second compression chamber so as to be connected with a second suction pipe, and a second vane slot disposed at one side of the second suction port. The second roller may be rotatably disposed in the second compression chamber. The second vane may be inserted into the second vane slot to be slidably coupled to the second cylinder, and rotatably coupled to an outer circumferential surface of the second roller. The intermediate plate may be disposed between the first cylinder and the second cylinder to isolate the first and second compression chambers from each other. A first partition wall may be disposed between the first suction port and the first vane slot and a second partition wall may be disposed between the second suction port and the second vane slot. An elastic portion may be formed in a recessed or penetrating manner at at least one of the first partition wall or the second partition wall. With this configuration, an elastic strain of the first partition wall and/or the second partition wall may be increased and each vane may be prevented from being excessively in contact with an inner surface of each vane slot, thereby enhancing energy efficiency of the compressor.

At least one of the first and second suction ports may be formed in a slot shape in which an inner circumferential surface thereof is recessed and both side surfaces in the axial direction are open. Accordingly, the first partition wall and/or the second partition wall may be formed in a kind of cantilever shape, so as to increase an elastic strain of each partition wall. In addition, a suction area may be increased so as to advance a compression starting time, thereby suppressing compression loss due to over-compression.

The elastic portion may be formed within a range of the suction port in a radial direction. This may further improve an elastic strain of the first partition wall and/or the second partition wall.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

at least one cylinder formed in an annular shape;

a plurality of bearing plates disposed, respectively, at both sides of the at least one cylinder in an axial direction;

at least one roller disposed in the at least one cylinder; and at least one vane slidably inserted into the at least one cylinder and configured to be slidable into contact with an outer circumferential surface of the at least one roller, wherein the at least one cylinder comprises:

a vane slot having an inner circumferential surface open so that the vane is slidably inserted therein;

a suction port having an inner circumferential surface open and disposed at one side of the vane slot in a circumferential direction; and a partition wall disposed between the vane slot and the suction port to partition the vane slot and the suction port from each other, and wherein the partition wall comprises at least one elastic portion recessed by a predetermined depth in the circumferential direction into an inner surface of the suction port defining one of circumferential side surfaces of the partition wall.

2. The rotary compressor of claim 1, wherein the at least one elastic portion is located at a position at which the at least one elastic portion overlaps a movement range of the at least one vane in a radial direction, on the inner surface of the suction port defining the one of the circumferential side surfaces of the partition wall.

3. The rotary compressor of claim 1, wherein the at least one elastic portion has a same cross-sectional area along the axial direction.

4. A rotary compressor, comprising:

at least one cylinder formed in an annular shape;

a plurality of bearing plates disposed, respectively, at both sides of the at least one cylinder in an axial direction;

at least one roller disposed in the at least one cylinder; and at least one vane slidably inserted into the at least one cylinder and configured to be slidable into contact with an outer circumferential surface of the at least one roller, wherein the at least one cylinder comprises:

a vane slot having an inner circumferential surface open so that the vane is slidably inserted therein;

a suction port having an inner circumferential surface open and disposed at one side of the vane slot in a circumferential direction; and a partition wall disposed between the vane slot and the suction port to partition the vane slot and the suction port from each other, and wherein the partition wall comprises at least one elastic portion that axially penetrates or is axially recessed and is spaced in the circumferential direction apart from an inner surface of the vane slot and an inner surface of the suction port defining the circumferential side surfaces of the partition wall.

5. The rotary compressor of claim 4, wherein the at least one elastic portion is spaced apart from the circumferential side surfaces of the partition wall at a same distance in the circumferential direction.

6. The rotary compressor of claim 4, wherein the at least one elastic portion has a same cross-sectional area along the axial direction.

7. A rotary compressor, comprising:

at least one cylinder formed in an annular shape;

a plurality of bearing plates disposed, respectively, at both sides of the at least one cylinder in an axial direction;

at least one roller disposed in the at least one cylinder; and at least one vane slidably inserted into the at least one cylinder and configured to be slidable into contact with an outer circumferential surface of the at least one roller, wherein the at least one cylinder comprises:

a vane slot having an inner circumferential surface open so that the vane is slidably inserted therein;

a suction port having an inner circumferential surface open and disposed at one side of the vane slot in a circumferential direction; and a partition wall disposed between the vane slot and the suction port to partition the vane slot and the suction port from each other, and wherein the partition wall comprises at least one elastic portion that penetrates or is recessed at at least one of circumferential side surfaces of the partition wall or between the circumferential side surfaces of the partition wall, wherein the at least one elastic portion comprises a plurality of elastic portions, wherein the plurality of elastic portions is spaced apart at predetermined distances along a radial direction of the partition wall, wherein the partition wall is configured such that a cross-sectional area at an inner circumferential side is smaller than a cross-sectional area at an outer circumferential side, and wherein each elastic portion of the plurality of elastic portions is configured such that a cross-sectional area of the elastic portion located at the inner circumferential side of the cylinder is smaller than a cross-sectional area of the elastic portion located at the outer circumferential side of the cylinder.

8. The rotary compressor of claim 7, wherein the plurality of elastic portions is provided at both of the circumferential side surfaces of the partition wall.

9. A rotary compressor, comprising:

at least one cylinder formed in an annular shape;

a plurality of bearing plates disposed, respectively, at both sides of the at least one cylinder in an axial direction;

at least one roller disposed in the at least one cylinder; and at least one vane slidably inserted into the at least one cylinder and configured to be slidable into contact with an outer circumferential surface of the at least one roller, wherein the at least one cylinder comprises:

a vane slot having an inner circumferential surface open so that the vane is slidably inserted therein;

a suction port having an inner circumferential surface open and disposed at one side of the vane slot in a circumferential direction; and a partition wall disposed between the vane slot and the suction port to partition the vane slot and the suction port from each other, wherein the partition wall comprises at least one elastic portion recessed in a rectangular shape for which at least a portion of the at least one elastic portion has a same width in the circumferential direction and extends lengthwise in a radial direction.

10. The rotary compressor of claim 9, wherein the at least one elastic portion has a same cross-sectional area along the axial direction.

11. A rotary compressor, comprising:

at least one cylinder formed in an annular shape;

a plurality of bearing plates disposed, respectively, at both sides of the at least one cylinder in an axial direction;

at least one roller disposed in the at least one cylinder; and at least one vane slidably inserted into the at least one cylinder and configured to be slidable into contact with an outer circumferential surface of the at least one roller, wherein the at least one cylinder comprises:

a vane slot having an inner circumferential surface open so that the vane is slidably inserted therein;

a suction port having an inner circumferential surface open and disposed at one side of the vane slot in a circumferential direction; and a partition wall disposed between the vane slot and the suction port to partition the vane slot and the suction port from each other, wherein the partition wall comprises at least one elastic portion recessed by a predetermined depth axially into at least one of axial side surfaces of the partition wall, and wherein the partition wall has a non-penetrating portion formed by blocking an inner end portion of the at least one elastic portion in the axial direction.

12. The rotary compressor of claim 11, wherein the predetermined depth of the at least one elastic portion in the axial direction is greater than or equal to a length of the non-penetrating portion in the axial direction.

13. The rotary compressor of claim 11, wherein the at least one elastic portion is formed on both axial side surfaces of the partition wall to be symmetrical with respect to the non-penetrating portion.

14. A rotary compressor, comprising:

at least one cylinder formed in an annular shape;

a plurality of bearing plates disposed, respectively, at both sides of the at least one cylinder in an axial direction;

at least one roller disposed in the at least one cylinder; and at least one vane slidably inserted into the at least one cylinder and configured to be slidable into contact with an outer circumferential surface of the at least one roller, wherein the at least one cylinder comprises:

a vane slot having an inner circumferential surface open so that the vane is slidably inserted therein;

a suction port having an inner circumferential surface open and disposed at one side of the vane slot in a circumferential direction; and a partition wall disposed between the vane slot and the suction port to partition the vane slot and the suction port from each other, wherein the partition wall comprises at least one elastic portion that penetrates or is recessed at at least one of circumferential side surfaces of the partition wall or between the circumferential side surfaces of the partition wall, wherein the at least one vane comprises at least one friction-avoiding portion chamfered on corners of an opposite end portion of the at least one vane from the roller, and wherein the at least one friction-avoiding portion is formed such that a friction-avoiding portion at a discharge side is more rounded or inclined than a friction-avoiding portion at a suction side, facing an inner surface of the vane slot defining the partition wall.

15. A rotary compressor, comprising:

at least one cylinder formed in an annular shape;

a plurality of bearing plates disposed, respectively, at both sides of the at least one cylinder in an axial direction;

at least one roller disposed in the at least one cylinder; and at least one vane slidably inserted into the at least one cylinder and configured to be slidable into contact with an outer circumferential surface of the at least one roller, wherein the at least one cylinder comprises:

a vane slot having an inner circumferential surface open so that the vane is slidably inserted therein;

a suction port having an inner circumferential surface open and disposed at one side of the vane slot in a circumferential direction; and a partition wall disposed between the vane slot and the suction port to partition the vane slot and the suction port from each other, wherein the partition wall comprises at least one elastic portion that penetrates or is recessed at at least one of circumferential side surfaces of the partition wall or between the circumferential side surfaces of the partition wall, wherein the suction port is recessed by a predetermined depth radially into an inner circumferential surface of the cylinder, and is open toward at least one of both axial side surfaces of the cylinder, and wherein the at least one elastic portion is formed at a position at which the at least one elastic portion overlaps the suction port in the circumferential direction.

16. The rotary compressor of claim 15, wherein a sealing distance between the at least one elastic portion and an inner surface of the suction port defining the circumferential side surface of the partition wall is longer than or equal to an inner circumferential length of the partition wall.

17. The rotary compressor of claim 15, wherein a space portion further extends from a radial outer end of the vane slot, wherein the space portion comprises an axial space portion that penetrates through both of the axial side surfaces of the cylinder, and a radial space portion that communicates from an outer circumferential surface of the cylinder to an inner circumferential surface of the axial space portion, and wherein the radial space portion is defined outside of a range of the vane slot in the radial direction.

18. A rotary compressor, comprising:

at least one cylinder formed in an annular shape;

a plurality of bearing plates disposed, respectively, at both sides of the at least one cylinder in an axial direction;

at least one roller disposed in the at least one cylinder; and at least one vane slidably inserted into the at least one cylinder and configured to be slidable into contact with an outer circumferential surface of the at least one roller, wherein the at least one cylinder comprises:

a vane slot having an inner circumferential surface open so that the vane is slidably inserted therein;

a suction port having an inner circumferential surface open and disposed at one side of the vane slot in a circumferential direction; and a partition wall disposed between the vane slot and the suction port to partition the vane slot and the suction port from each other, and wherein the partition wall comprises at least one elastic portion in the form of at least one hole or recess formed between and spaced apart from both circumferential side surfaces of the partition wall.

* * * * *